US005518846A

United States Patent [19]

Hoshi et al.

[11] Patent Number: 5,518,846

[45] Date of Patent: May 21, 1996

[54] ELECTROPHOTOGRAPHIC PHOTORECEPTOR AND ELECTROPHOTOGRAPHIC PRINTING PLATE PRECURSOR

[75] Inventors: Satoshi Hoshi; Naonori Makino; Katsuji Kitatani, all of Kanagawa, Japan

[73] Assignee: Fuji Photo Film Co., Ltd., Kanagawa, Japan

[21] Appl. No.: 694,519

[22] Filed: May 1, 1991

[30] Foreign Application Priority Data

May 2, 1990 [JP] Japan ..... 2-116024

[51] Int. Cl.[6] ..... G03G 15/02

[52] U.S. Cl. ..... 430/58; 430/59; 430/76; 430/78

[58] Field of Search ..... 430/58, 59, 76, 430/78

[56] References Cited

U.S. PATENT DOCUMENTS

| | | | |
|---|---|---|---|
| 4,504,559 | 3/1985 | Makino et al. | 430/58 |
| 4,882,249 | 11/1989 | Kitatani et al. | 430/58 |
| 4,977,051 | 12/1990 | Ohno et al. | 430/58 |
| 4,985,324 | 1/1991 | Kitatani et al. | 430/58 |

*Primary Examiner*—Mark Chapman
*Attorney, Agent, or Firm*—Sughrue, Mion, Zinn, Macpeak & Seas

[57] ABSTRACT

A novel electrophotographic photoreceptor is provided, comprising on an electrically conductive support a light-sensitive layer containing at least one acetylene disazo compound represented by the general formula (I):

$$Cp—N{=}N—Ar^1—C{\equiv}C—Ar^2N{=}N—Cp \quad (I)$$

wherein $Ar^1$ and $Ar^2$ each represents an unsubstituted or substituted arylene group, divalent condensed polycyclic aromatic group or divalent aromatic heterocyclic group, with the proviso that $Ar^1$ and $Ar^2$ are not phenylene groups at the same time; and Cp represents a coupler residue. A novel electrophotographic printing plate precursor is also provided which comprises on an electrically conductive support a photoconducting layer containing at least a charge-generating substance, a charge-transporting substance and a binding resin and is adapted to be subjected to a process which comprises imagewise exposure of said precursor to form a toner image, and then removal of said photoconducting layer from the nonimage portion other than said toner image portion to form a printing plate, characterized in that said charge-generating substance is an acetylene disazo compound represented by the general formula (I).

15 Claims, No Drawings

ELECTROPHOTOGRAPHIC PHOTORECEPTOR AND ELECTROPHOTOGRAPHIC PRINTING PLATE PRECURSOR

FIELD OF THE INVENTION

The present invention relates to an electrophotographic photoreceptor and electrophotographic printing plate precursor. More particularly, the present invention relates to an electrophotographic photoreceptor comprising a layer containing a novel charge-generating substance or layer containing a novel photoconducting substance and an electrophotographic printing plate precursor containing as main components a charge-generating substance, a charge-transporting substance and an alkali-soluble binding resin.

BACKGROUND OF THE INVENTION

As photoconductive materials to be incorporated in electrophotographic photoreceptors there have heretofore been used inorganic substances such as selenium, cadmium sulfide, zinc oxide and amorphous silicon. These inorganic substances are advantageous in that they have excellent electrophotographic properties. In particular, these inorganic substances exhibit an extremely excellent photoconductivity, charge acceptability in a dark place and insulating properties. On the contrary, however, these inorganic substances have various disadvantages. For example, selenium photoreceptors are expensive to manufacture, have no flexibility and cannot withstand thermal or mechanical shock. Cadmium sulfide photoreceptors, which comprise a toxic material (cadmium), can cause a problem of pollution. Zinc oxide photoreceptors exhibit difficulty in image stability upon prolonged repeated use. Furthermore, amorphous silicon photoreceptors are disadvantageous in that they are extremely expensive to manufacture and need a special surface treatment to inhibit deterioration of the surface thereof.

In recent years, electrophotographic photoreceptors comprising various organic substances have been proposed to eliminate these disadvantages of such inorganic photoconductive materials. Some of these electrophotographic photoreceptors have been put into practical use. Examples of such electrophotographic photoreceptors include electrophotographic photoreceptors comprising poly-N-vinylcarbazole and 2,4,7-trinitrofluorenone-9-one as disclosed in U.S. Pat. No. 3,484,237, electrophotographic photoreceptors obtained by sensitizing poly-N-vinylcarbazole with a pyririum dye as disclosed in JP-B-48-25658 (the term "JP-B" as used herein means an "examined Japanese patent publication"), and electrophotographic photoreceptors comprising as main component an eutectic complex made of a dye and a resin as disclosed in JP-A-47-10735 (the term "JP-A" as used herein means an "unexamined published Japanese patent application disclosure").

Furthermore, active studies have been recently made on and many proposals have been made for electrophotographic photoreceptors comprising as main component an organic pigment such as perylene pigment as disclosed in U.S. Pat. No. 3,371,884, phthalocyanine pigment as disclosed in U.S. Patent 3,397,086 and 4,666,802, azlenium salt pigment as disclosed in JP-A-59-53850 and JP-A-61-212542, squarium salt pigment as disclosed in U.S. Pat. Nos. 4,396,610 and 4,644,082 and polycyclic quinone pigment as disclosed in JP-A-59-184348 and JP-A-62-28738 or the following azo pigments:

Disazo pigments as disclosed in JP-A-53-133445, JP-A-59-78356, JP-A-59-128547, JP-A-61-57945, JP-A-61-17150, JP-A-62-251752, JP-A-62-273545, JP-A-64-13555, and JP-A-64-79753, JP-B-63-18740 and JP-B-2-4893, and U.S. Pat. No. 4,504,559;

Trisazo pigments as disclosed in JP-A-58-160358 and JP-A-61-251865, and JP-B-62-39626 and JP-B-63-10419; and Tetrakisazo pigments as disclosed in JP-A-61-182051 and JP-A-62-18565.

On the other hand, PS plates comprising a positive type sensitizing agent containing a diazo compound and a phenolic resin as main components or a negative type sensitizing agent containing an acrylic monomer or prepolymer as main component have heretofore been put into practical use as lithographic offset printing plate precursors. However, since all these printing plate precursors have a low sensitivity, these printing plate precursors are exposed to light with a film original on which an image have been previously recorded brought into close contact therewith to form printing plates. Furthermore, the progress of computer image processing technique and large capacity data storage and communication techniques have recently enabled a continuous computer operation including original input, correction, editing, layout and paging. With this computer operation, an electronic editing system capable of instantly outputting data to terminal plotters via high speed communications network or satellite communications network has been put into practical use. In particular, such an electronic editing system is in great demand in the field of newspaper printing requiring instantaneity. Furthermore, in the field of printing wherein a printing plate is reproduced as necessary based on an original stored in the form of film original, a tendency will be growing that originals are stored as digital data in large capacity recording media such as optical disc which will be developed.

However, little or no direct type printing plate precursors designed to directly receive data from the output of terminal plotters to form a printing plate have been put into practical use. Even in stations where an electronic editing system is operated, data is outputted to a silver salt system photographic film. PS plates are then exposed to light with the silver salt system photographic film brought into contact therewith to form printing plates. One of the reasons for the above described conditions is that it is difficult to provide a direct type printing plate precursor having a sensitivity high enough to form a printing plate within a practical period of time by a light source in the output plotter (e.g., He—Ne laser, semiconductor laser).

An electrophotographic light-sensitive material can be a light-sensitive material having a light sensitivity high enough to provide a direct type printing plate.

As printing plate materials (printing plate precursors) utilizing electrophotography there have been heretofore known zinc oxide-resin dispersion system offset printing plate materials as disclosed in JP-B-47-47610, JP-B-48-40002, JP-B-48-18325, JP-B-51-15766, and JP-B-51-25761. Such a printing plate material is designed to undergo an electrophographic process which comprises the formation of toner images and then a treatment which comprises impregnation with a desensitizing solution (e.g., acidic aqueous solution containing a ferrocyanide or ferricyanide) to desensitize the non-image portion. Offset printing plates thus treated have a printing resistance of 5,000 to 10,000 sheets and thus are not suitable for printing of more than 10,000 sheets. This system is also disadvantageous in that if it comprises a composition suitable for densitization, it is susceptible to deterioration in static properties and picture quality. This system is further disadvantageous in that as a desensitizing solution there must be used a harmful cyanide compound.

In an organic photoconductor-resin system printing plate material as disclosed in JP-B-37-17162, JP-B-38-7758, JP-B-46-39405, and JP-B-52-2437, an electrophotographic photoreceptor is used which comprises on a grained aluminum plate a photoconducting insulating layer comprising, e.g., an oxazole or oxadiazole compound bound with a styrene-maleic anhydride copolymer. The electrophogrphic photoreceptor is designed to undergo an electrophotographic process which comprises the formation of toner image and then dissolution and removal of the nonimage portion with an alkali-soluble organic solvent to form a printing plate.

Sato et al. of Fuji Photo Film Co., Ltd. disclose an electrophotographic printing plate precursor comprising a hydrazone compound and barbituric acid or thiobarbituric acid in JP-A-57-147656. Besides such an electrophotographic plate precursor, dye-sensitized electrophotographic printing plates as disclosed in JP-A-59-147335, JP-A-59-152456, JP-A-59-168462, and JP-A-58-145495 have been known. However, such dye-sensitized electrophotographic printing plates cannot provide a sufficient sensitivity. Thus, it has been desired to provide a photoconductor having a higher sensitivity. As an approach for solving this problem there have been known a dispersion of a charge carrier-generating compound such as phthalocyanine compound, azo compound and condensed polycyclic quinone compound in a binding resin as disclosed in JP-A-55-161250, JP-A-56-146145 and JP-A-60-17751. However, none of these approaches can provide a sufficient sensitivity or charge retention.

These electrophotographic photoreceptors can provide some improvement in mechanical properties and flexibility of the above mentioned inorganic electrophotographic photoreceptors but leave to be desired in sensitivity. These electrophotographic photoreceptors are also subject to change in electrical properties upon repeated use over many times. Thus, these electrophotographic photoreceptors cannot necessarily satisfy the requirements for electrophotographic photoreceptors.

The above mentioned electrophotographic printing plate precursors don't have sensitivity high enough to form a direct type printing plate. Even if the above mentioned electrophotographic printing plate precursors exhibit a high sensitivity, they leave to be desired in charge retention. Thus, the above mentioned electrophotographic printing plate precursors cannot necessarily satisfy the requirements.

SUMMARY OF THE INVENTION

It is therefore an object of the present invention to provide a novel electrophotographic photoreceptor which exhibits a high sensitivity and a high durability.

It is another object of the present invention to provide a novel electrophotographic photoreceptor which is little subject to drop in light sensitivity upon repeated use.

It is a further object of the present invention to provide an electrophotographic printing plate precursor which exhibits a sensitivity high enough to form a direct type printing plate by laser.

It is a still further object of the present invention to provide an electrophotographic printing plate precursor which exhibits excellent static properties.

It is a further object of the present invention to provide an electrophotographic printing plate precursor which exhibits excellent printing properties.

These and other objects of the present invention will become more apparent from the following detailed description and examples.

These objects of the present invention are accomplished with an electrophotographic photoreceptor comprising on an electrically conductive support a light-sensitive layer containing at least one acetylene disazo compound represented by the general formula (I):

$$Cp—N{=}N—Ar^1—C{\equiv}C—Ar^2N{=}N—Cp \quad (I)$$

wherein $Ar^1$ and $Ar^2$ each represents an unsubstituted or substituted arylene group, divalent condensed polycyclic aromatic group or divalent aromatic heterocyclic group, with the proviso that $Ar^1$ and $Ar^2$ are not phenylene groups at the same time; and Cp represents a coupler residue.

These and other objects of the present invention are also accomplished with an electrophotographic printing plate precursor which comprises on an electrically conductive support a photoconducting layer containing at least a charge-generating substance, a charge-transporting substance and a binding resin and is adapted to be subjected to a process which comprises imagewise exposure of said precursor to form a toner image, and then removal of said photoconducting layer from the nonimage portion other than said toner image portion to form a printing plate, characterized in that said charge-generating substance is an acetylene disazo compound represented by the general formula (I).

DETAILED DESCRIPTION OF THE INVENTION

The acetylene disazo compound of the present invention will be further described hereinafter.

The arylene group represented by $Ar^1$ and $Ar^2$ contains from 6 to 18 carbon atoms and the divalent condensed polycyclic aromatic group represented by $Ar^1$ and $Ar^2$ contains 8 to 24 carbon atoms.

Specific examples of the unsubstituted arylene group represented by $Ar^1$ or $Ar^2$ include phenylene group, naphthylene group, anthrylene group, biphenylene group, and terphenylene group. Specific examples of the condensed polycyclic aromatic group represented by $Ar^1$ or $Ar^2$ include divalent groups derived from indene, perylene, anthrone, anthraquinone, benzoanthrone, isocoumarin, pyrene, acenaphthene, fluorene, azulene, etc.

The divalent aromatic heterocyclic group represented by $Ar^1$ and $Ar^2$ is a 5- to 7-membered $C_{3-18}$ group containing O, S, N or Se as a hetero atom.

Specific examples of the unsubstituted aromatic heterocyclic group represented by $Ar^1$ or $Ar^2$ include divalent groups derived from furan, thiophene, pyridine, quinoline, oxazole, thiazole, oxadiazole, benzoxazole, benzoimidazole, benzothiazole, benzotriazole, dibenzofuran, carbazole, xanthene, etc.

If $Ar^1$ and $Ar^2$ each represents an aromatic carbon ring containing substituents, specific examples of such substituents include $C_{1-18}$ alkyl group (e.g., methyl, ethyl, n-propyl), halogen atom (e.g., fluorine, chlorine, bromine, iodine), cyano group, nitro group, hydroxyl group, carboxyl group, $C_{1-18}$ alkoxy group (e.g., methoxy, ethoxy, propoxy, butoxy), $C_{6-18}$ aryloxy group (e.g., phenoxy, o-tolyloxy, m-tolyloxy, p-tolyloxy, 1-naphthyloxy), $C_{2-36}$ dialkylamino group (e.g., dimethylamino, diethylamino, dibutylamino), $C_{12-36}$ diarylamino group (e.g., diphenylamino, phenyltolylamino), $C_{7-36}$ N-alkyl-N-arylamino group (e.g., N-methyl-N-phenylamino, N-ethyl-N-phenylamino), $C_{6-18}$ aryl group (e.g., phenyl, naphthyl), $C_{3-54}$ trialkylsilyl group (e.g., trimethylsilyl, t-butyldimethylsilyl), $C_{1-18}$ halogenalkyl group (e.g., chloromethyl, trifluoromethyl), and $C_{1-18}$ alkylthio group (e.g., methylthio, ethylthio). These substituents may be bonded to any carbon atoms in $Ar^1$ and $Ar^2$ in any numbers.

Cp represents a known coupler residue which reacts with a diazonium salt, preferably known coupler residue of azo compound to be used as charge-generating compound for electrophotographic photoreceptors. Particularly preferred examples of Cp include couplers residues having the following chemical structures:

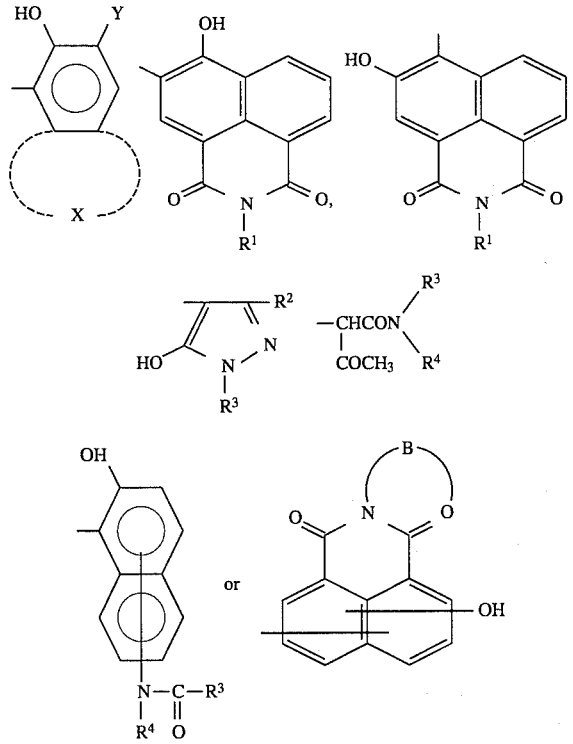

wherein X represents an atomic group which undergoes condensation with the benzene ring to which the hydroxyl group and Y are connected to form an aromatic group (having 8 to 18 carbon atoms) such as naphthalene ring and anthracene ring or a heterocyclic group (e.g., 5- to 7-membered $C_{7-22}$ group containing O, S, Se or N as a hereto atom) such as indole ring, carbazole ling, benzocarbazole ring and dibenzofuran ring.

If X is an aromatic ring or heterocyclic group containing substituents, examples of these substituents include halogen atom (e.g., fluorine, chlorine, bromine), $C_{1-18}$ (e.g., methyl, ethyl, propyl, butyl, dodecyl, octadecyl, isopropyl, isobutyl), trifluoromethyl group, nitro group, amino group, cyano group, and $C_{1-8}$ alkoxy group (e.g., methoxy, ethoxy, butoxy). These substituents may be bonded to any positions in any numbers.

Y represents $—CONR^3R^4$, $—CONHN{=}CR^3R^4$, $—COOR^3$ or 5- to 7-membered (preferably 5- or 6-membered) $C_{3-18}$ heterocyclic ring containing O, S, Se or N as a hetero atom which may contain substituents.

$R^1$ represents a $C_{1-12}$ alkyl or $C_{6-18}$ aryl group.

Specific examples of the unsubstituted alkyl group represented by $R^1$ include methyl group, ethyl group, propyl group, butyl group, hexyl group, isopropyl group, isobutyl group, isoamyl group, isohexyl group, neopentyl group, and tert-butyl group.

If $R^1$ is a substituted alkyl group, examples of such substituents include hydroxyl group, $C_{1-12}$ alkoxy group, cyano group, amino group, $C_{1-12}$ alkylamino group, dialkylamino group containing two $C_{1-12}$ alkyl groups, halogen atom, and $C_{6-15}$ aryl group. Examples of such a substituted alkyl group include hydroxyalkyl group (e.g., hydroxymethyl, 2-hydroxyethyl, 3-hydroxypropyl, 2-hydroxypropyl), alkoxyalkyl group (e.g., methoxymethyl, 2-methoxyethyl, 3-methoxypropyl, ethoxymethyl, 2-ethoxyethyl), cyanoalkyl group (e.g., cyanomethyl, 2-cyanoethyl), aminoalkyl group (e.g., aminomethyl, 2-aminoethyl, 3-aminopropyl), (alkylamino)alkyl group (e.g., (methylamino)methyl, 2-(methylamino)ethyl, (ethylamino)methyl), (dialkylamino)alkyl group (e.g., (dimethylamino)methyl, 2-(dimethylamino)ethyl), halogenoalkyl group (e.g., fluoromethyl, trifluoromethyl, chloromethyl), and aralkyl group (e.g., benzyl, phenethyl).

Specific examples of the unsubstituted aryl group represented by $R^1$ include phenyl group, naphthyl group, and antolyl group.

If $R^1$ is a substituted aryl group, examples of such substituents include hydroxyl group, $C_{1-12}$ alkoxy group, cyano group, amino group, $C_{1-12}$ alkylamino group, dialkylamino group containing two $C_{1-12}$ alkyl groups, $C_{6-12}$ arylazo group, halogen atom, $C_{1-12}$ alkyl group, nitro group, and triflouromethyl group. Examples of such a substituted aryl group include hydroxyphenyl group, alkoxyphenyl group (e.g., methoxyphenyl, ethoxyphenyl), cyanophenyl group, aminophenyl group, (alkylamino)phenyl group (e.g., (methylamino)phenyl, (ethylamino)phenyl), (dialkylamino)phenyl group (e.g., (dimethylamino)phenyl, (diethylamino)phenyl), halogenophenyl group (e.g., fluorophenyl, chlorophenyl, bromophenyl), alkylphenyl group (e.g., tolyl, ethylphenyl, cumenyl, xylyl, mesityl), nitrophenyl group, trifluoromethylphenyl group, and phenyl group containing two or three of such substituents (which may be the same or different). These substituents may be connected to any positions.

Preferred examples of $R^2$ include hydrogen atom, $C_{1-6}$ lower alkyl group, carbamoyl group, carboxyl group, alkoxycarbonyl group containing $C_{1-12}$ alkoxy group, aryloxycarbonyl group containing $C_{6-20}$ aryloxy group, and substituted or unsubstituted amino group.

Specific examples of the substituted amino group represented by $R^2$ include methylamino group, ethylamino group, propylamino group, phenylamino group, tolylamino group, benzylamino group, diethylamino group, and diphenylamino group.

Specific examples of the lower alkyl group represented by $R^2$ include methyl group, ethyl group, propyl group, butyl group, isopropyl group, and isobutyl group.

Specific examples of the alkoxycarbonyl group represented by $R^2$ include methoxycarbonyl group, ethoxycarbonyl group, propoxycarbonyl group, butoxycarbonyl group, isopropoxycarbonyl group, and benzyloxycarbonyl group.

Specific examples of the aryloxycabonyl group represented by $R^2$ include phenoxycarbonyl group, toluoxycarbonyl group.

Preferred examples of $R^3$ include $C_{1-20}$ alkyl group, $C_{6-18}$ aromatic hydrocarbon group such as phenyl group and naphthyl group, aromatic heterocyclic group (e.g., 5- to 7-membered $C_{3-18}$ group containing O, S, Se or N as a hetero atom) such as dibenzofuranyl group, carbazolyl group and dibenzocarbazolyl group, and substituted compounds thereof.

Specific examples of the substituted or unsubstituted alkyl group represented by $R^3$ include those described with reference to $R^1$.

If $R^3$ is an aromatic carbon ring or aromatic heterocyclic group containing substituents, specific examples of such substituents include hydroxyl group, cyano group, nitro group, halogen atom (e.g., fluorine, chlorine, bromine), $C_{1-12}$ alkyl group (e.g., methyl, ethyl, propyl, isopropyl), $C_{1-12}$ alkoxy group (e.g., methoxy, ethoxy, propoxy, butoxy, pentyloxy, isopropoxy, isobutoxy, isoamyloxy, tert-butoxy, neopentyloxy), trifluoromethyl group, trimethylsilyl group, methanesulfonyl group, amino group, $C_{1-12}$ alkylamino group (e.g., methylamino, ethylamino, propylamino), $C_{2-12}$ dialkylamino group (e.g., dimethylamino, diethylamino, N-methyl-N-ethylamino), $C_{6-12}$ arylamino group (e.g., phenylamino, tolylamino), diarylamino group containing two $C_{6-15}$ aryl groups (e.g., diphenylamino), $C_{6-12}$ arylazo group (e.g., phenylazo, chlorophenylazo, fluorophenylazo, bromophenylazo, cyanophenylazo, ethoxycarbonylphenylazo, nitrophenylazo, acetamidephenylazo, methoxyphenylazo, methylphenylphenylazo, n-octylphenylazo, trifluoromethylphenylazo, trimethylsilylphenylazo, methanesulfonylazo), carboxyl group, alkoxycarbonyl group containing $C_{1-18}$ alkoxy group (e.g., methoxycarbonyl, ethoxycarbonyl), aryloxycarbonyl group containing $C_{6-16}$ aryloxy group (e.g., phenoxycarbonyl, naphthoxycarbonyl), carboxylate of alkaline metal (examples of alkaline metal cations include $Na^{\oplus}$, $K^{\oplus}$ and $Li^{\oplus}$), sulfonate of alkaline metal (examples of alkaline metal cations include $Na^{\oplus}$, $K^{\oplus}$ and $Li^{\oplus}$), $C_{1-18}$ alkylcarbonyl group (e.g., acetyl, propionyl, benzylcarbonyl), arylcarbonyl group containing $C_{6-12}$ aryl group (e.g., benzoyl, toluoil), $C_{1-12}$ alkylthio group (e.g., methylthio, ethylthio), and $C_{1-12}$ arylthio group (e.g., phenylthio, tolylthio). There may be contained 1 to 5 such substituents. If a plurality of such substituents are contained in $R^3$ they may be the same or different. These substituents may be bonded to any positions.

Examples of $R^4$ include hydrogen atom and those described with reference to $R^3$.

Specific examples of the unsubstituted 5- or 6-membered heterocyclic ring represented by Y include imidazole ring, oxazole ring, thiazole ring, benzoimidazole ring, benzothiazole ring, benzoxazole ring, pyrimidine ring, and perimidine ring.

If Y represents a 5- or 6-membered heterocyclic ring containing substituents, specific examples of such substituents include those described with reference to the substituted aromatic carbon ring represented by $R^3$.

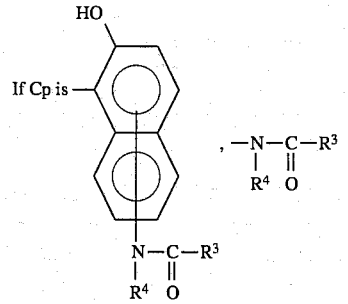

may be connected to any of the 3- to 8-positions, preferably to the 8-position.

B represents a divalent $C_{6-18}$ aromatic hydrocarbon group or divalent heterocyclic group (e.g., 5- to 7-membered $C_{2-18}$ group containing O, S, Se or N as a hetero atom) preferably containing nitrogen atom in the ring. Such a group may be substituted by $C_{1-18}$ alkyl group, halogen atom, nitro group, trifluoromethyl group, cyano group, hydroxyl group or the like. Examples of the divalent aromatic hydrocarbon group represented by B include o-phenylene group, o-naphtylene group, perinaphthylene group, 1,2-anthraquinone group, and 9,10-phenantolylene group. Examples of the divalent heterocyclic group containing nitrogen atom in the ring represented by B include 3,4-pyrazoledilyl group, 2,3-pyridiil group, 4,5-pyrimidineil group, 6,7-indazolediil group, 5,6-benzimidazolediil group, and 6,7-quinolinediil group.

Specific examples of the, acetylene disazo compound represented by the general formula (I) will be set forth in Table 1, but the present invention should not be construed as being limited thereto. Cp' in specific examples of the disazo compound represented by the general formula (I') represents a coupler residue set forth in Table 2, 3 or 4.

TABLE 1

$$Cp'-N=N-Ar^1-C\equiv C-Ar^2-N=N-Cp' \quad (I')$$

| Compound | $Ar^1$ | $Ar^2$ |
|---|---|---|
| (1) | 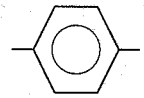 | 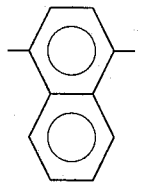 |
| (2) | 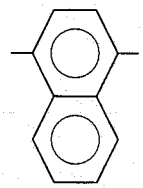 | 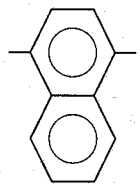 |

TABLE 1-continued
$Cp'-N=N-Ar^1-C\equiv C-Ar^2-N=N-Cp'$ (I')
| Compound | $Ar^1$ | $Ar^2$ |
|---|---|---|
| (3) | 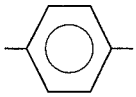 | 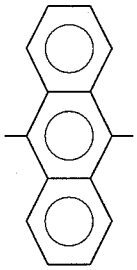 |
| (4) | 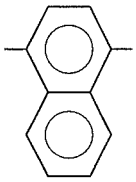 | 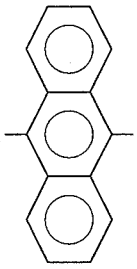 |
| (5) | 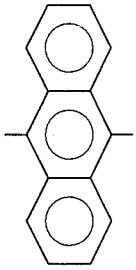 | 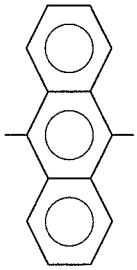 |
| (6) | 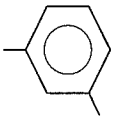 | 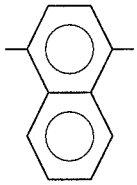 |
| (7) | 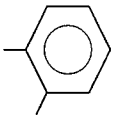 | 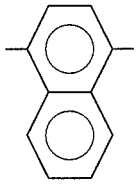 |
| (8) | 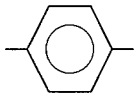 | 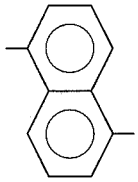 |
| (9) | 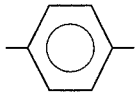 | 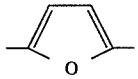 |

TABLE 1-continued
$Cp'-N=N-Ar^1-C\equiv C-Ar^2-N=N-Cp'$ (I')
| Compound | $Ar^1$ | $Ar^2$ |
|---|---|---|
| (10) | 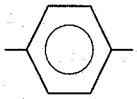 | 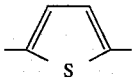 |
| (11) | 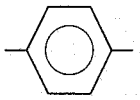 | 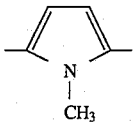 |
| (12) | 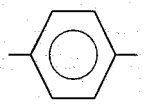 | 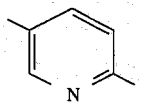 |
| (13) | 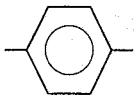 | 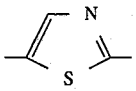 |
| (14) | 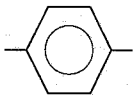 | 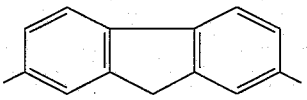 |
| (15) | 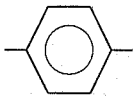 | 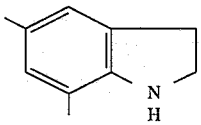 |
| (16) | 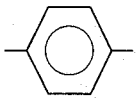 | 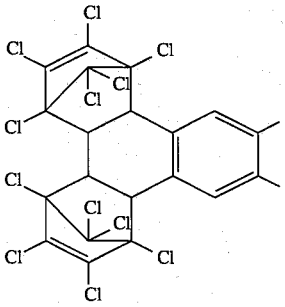 |
| (17) | 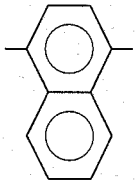 | 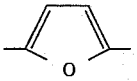 |
| (18) | 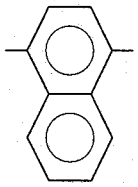 | 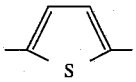 |
| (19) | 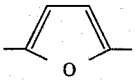 | 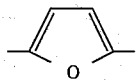 |

TABLE 1-continued
$Cp'-N=N-Ar^1-C\equiv C-Ar^2-N=N-Cp'$ (I')
| Compound | $Ar^1$ | $Ar^2$ |
|---|---|---|
| (20) | 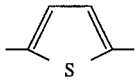 | 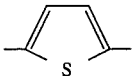 |
| (21) | 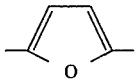 | 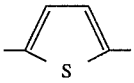 |
| (22) | 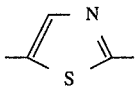 | 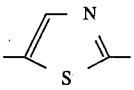 |
| (23) | 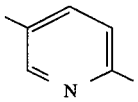 | 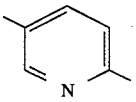 |
| (24) | 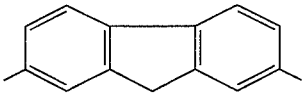 | 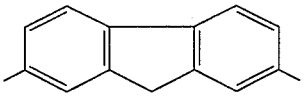 |
| (25) | 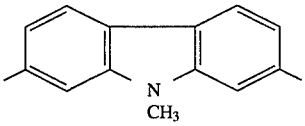 | 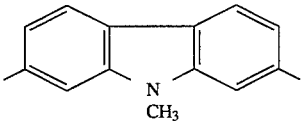 |
| (26) | 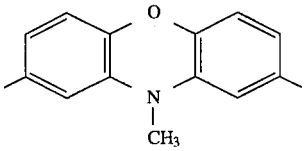 | 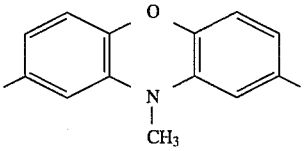 |
| (27) | 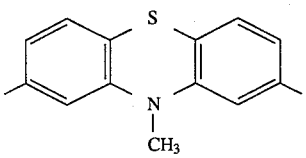 | 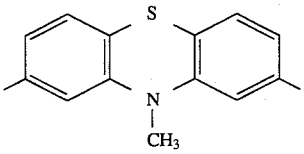 |
| (28) | 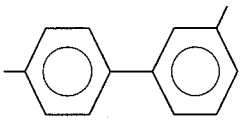 | 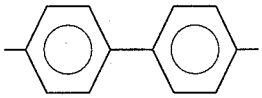 |
| (29) | 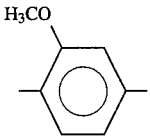 | 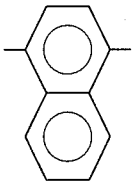 |
| (30) | 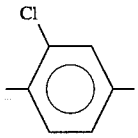 | 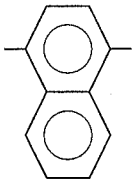 |

TABLE 1-continued
$$Cp'-N=N-Ar^1-C\equiv C-Ar^2-N=N-Cp' \quad (I')$$
| Compound | $Ar^1$ | $Ar^2$ |
|---|---|---|
| (31) | 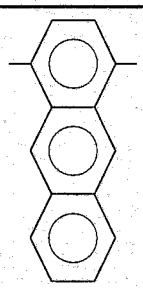 | 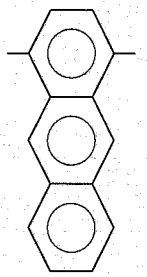 |
| (32) | 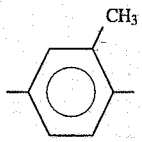  | 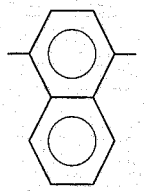 |
| (33) | 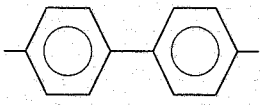 | 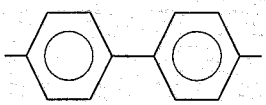 |
| (34) | 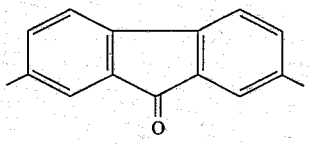  | 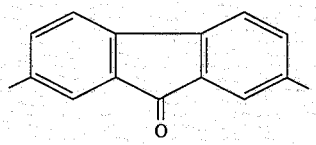  |
| (35) | 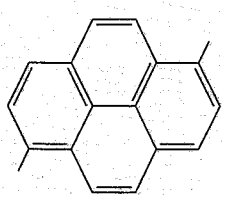 | 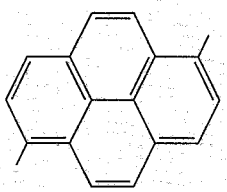 |
| (36) | 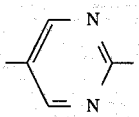  | 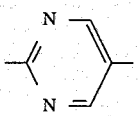  |
| (37) | 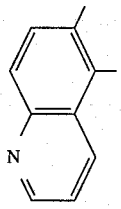  | 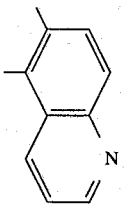  |

TABLE 2
| No. of Cp' | Cp' |
|---|---|
| (Cp'-1) | 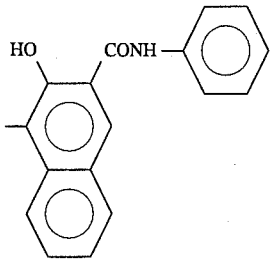 |
| (Cp'-2) | 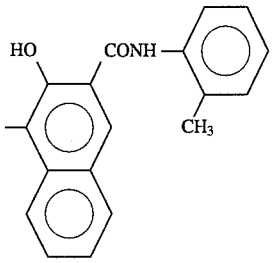 |
| (Cp'-3) | 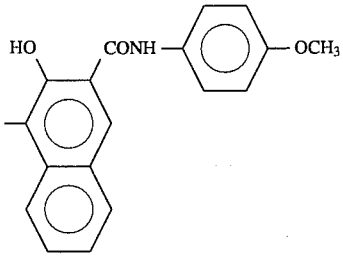 |
| (Cp'-4) | 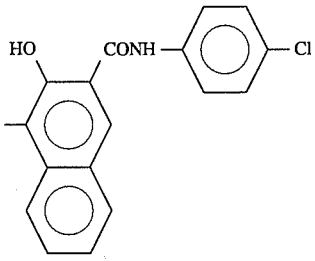 |
| (Cp'-5) | 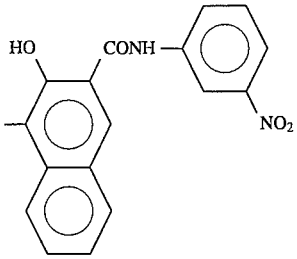 |
| (Cp'-6) | 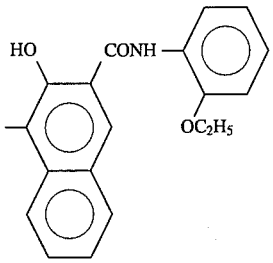 |
TABLE 2-continued
| No. of Cp' | Cp' |
|---|---|
| (Cp'-7) | 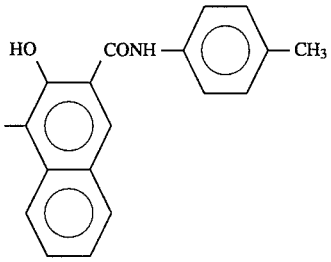 |
| (Cp'-8) | 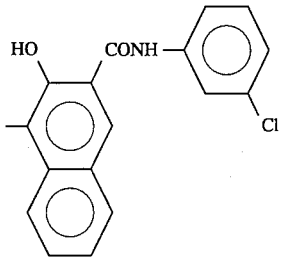 |
| (Cp'-9) | 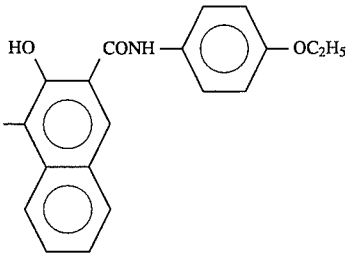 |
| (Cp'-10) | 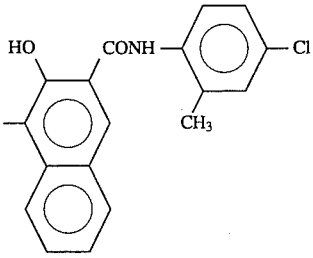 |
| (Cp'-11) | 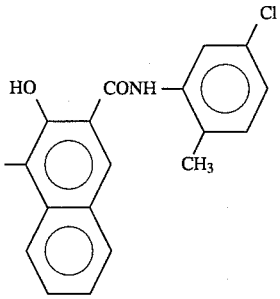 |

TABLE 2-continued
| No. of Cp' | Cp' |
|---|---|
| (Cp'-12) | 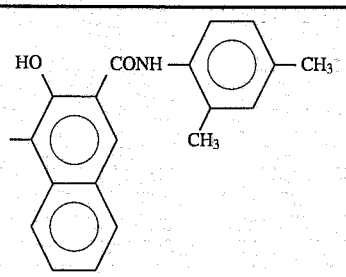 |
| (Cp'-13) | 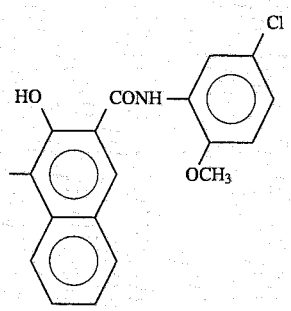 |
| (Cp'-14) | 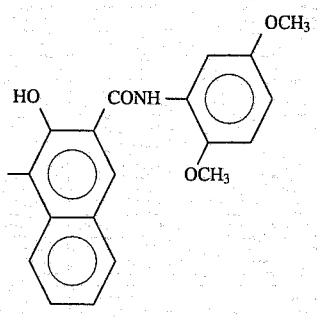 |
| (Cp'-15) | 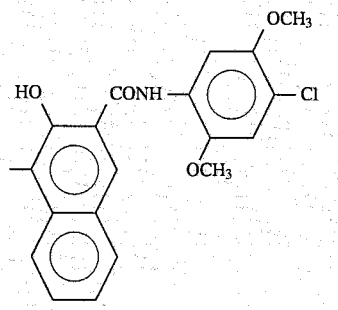 |
| (Cp'-16) | 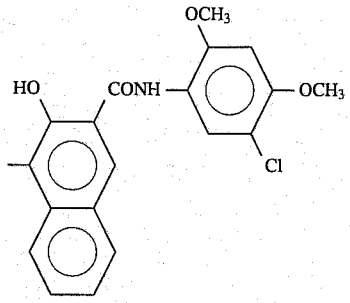 |
TABLE 2-continued
| No. of Cp' | Cp' |
|---|---|
| (Cp'-17) | 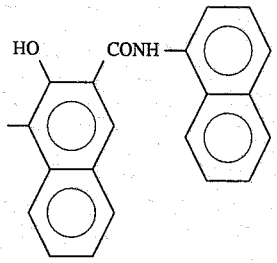 |
| (Cp'-18) | 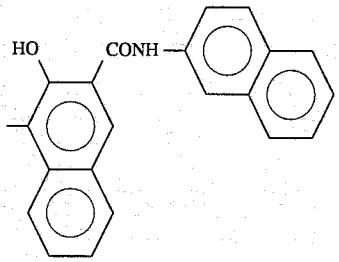 |
| (Cp'-19) | 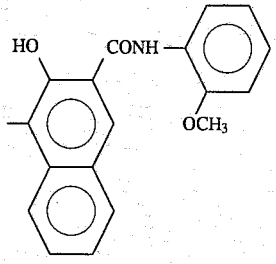 |
| (Cp'-20) | 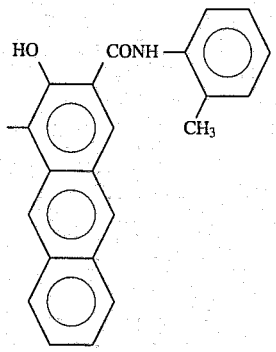 |
| (Cp'-21) | 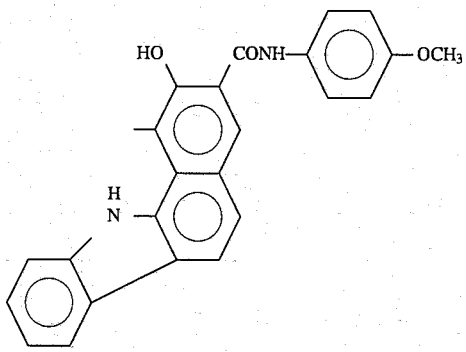 |

TABLE 2-continued
| No. of Cp' | Cp' |
|---|---|
| (Cp'-22) | 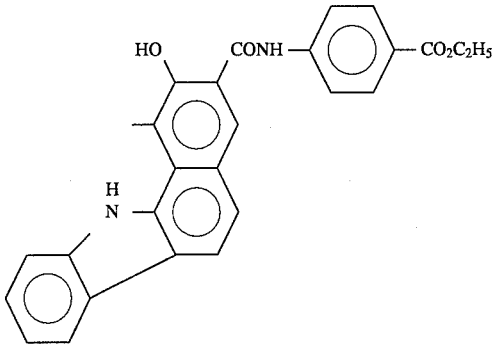 |
| (Cp'-23) | 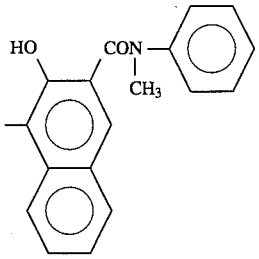 |
| (Cp'-24) | 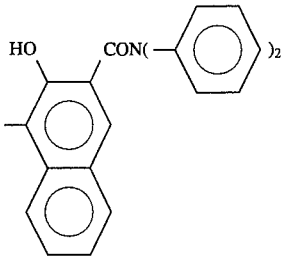 |
| (Cp'-25) | 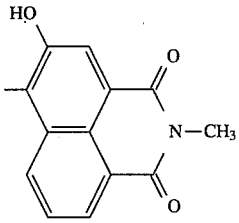 |
| (Cp'-26) | 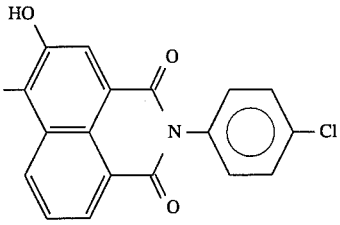 |
| (Cp'-27) | 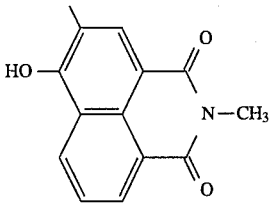 |
TABLE 2-continued
| No. of Cp' | Cp' |
|---|---|
| (Cp'-28) | 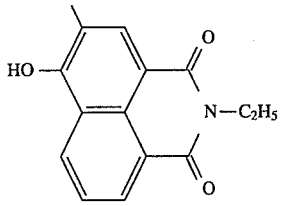 |
| (Cp'-29) | 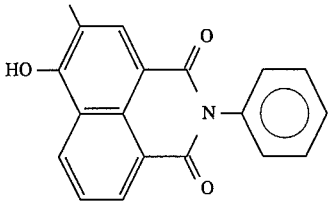 |
| (Cp'-30) | 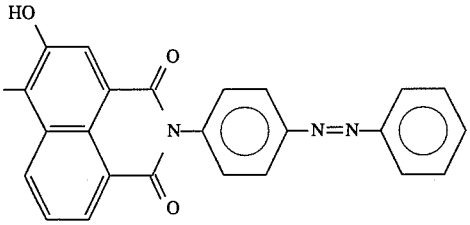 |
| (Cp'-31) | 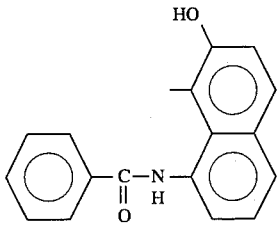 |
| (Cp'-32) | 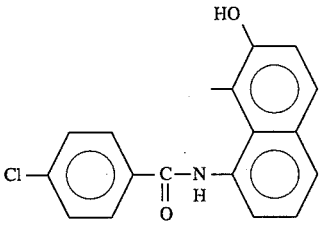 |
| (Cp'-33) | 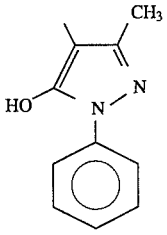 |

TABLE 2-continued
| No. of Cp' | Cp' |
|---|---|
| (Cp'-34) | 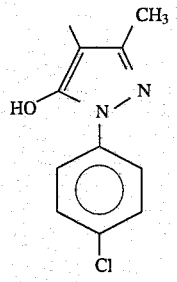 |
TABLE 2-continued
| No. of Cp' | Cp' |
|---|---|
| (Cp'-35) | 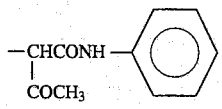 |
| (Cp'-36) | 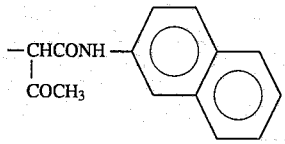 |
TABLE 3
| | Ar | | | |
|---|---|---|---|---|
| | 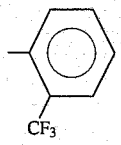 | 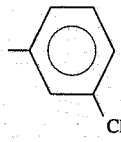 | 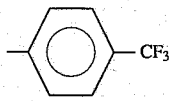 | 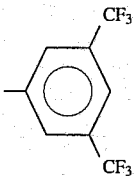 |
| 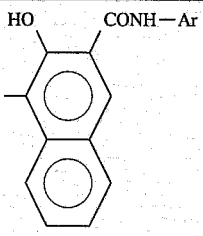 | Cp'-37 | Cp'-38 | Cp'-39 | Cp'-40 |
| 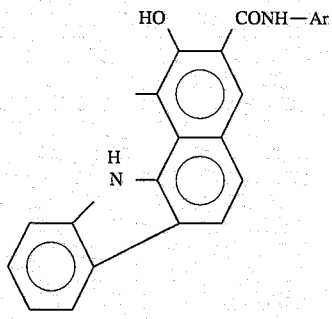 | Cp'-49 | Cp'-50 | Cp'-51 | Cp'-52 |
| 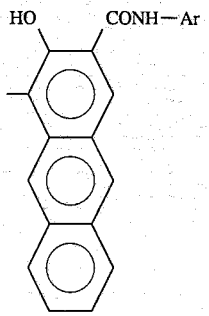 | Cp'-61 | Cp'-62 | Cp'-63 | Cp'-64 |

TABLE 3-continued
| | Ar | | | |
|---|---|---|---|---|
| 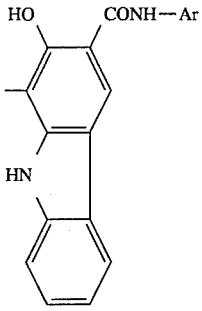 | Cp'-73 | Cp'-74 | Cp'-75 | Cp'-76 |
| 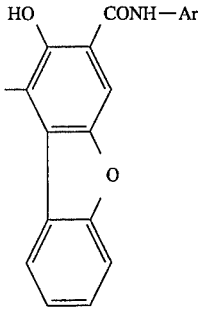 | Cp'-85 | Cp'-86 | Cp'-87 | Cp'-88 |
| | 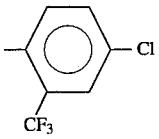 | 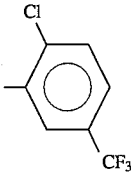 | 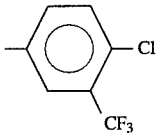 | 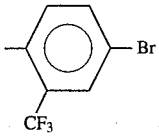 |
| 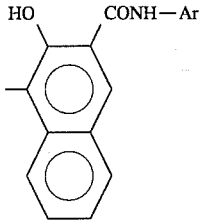 | Cp'-41 | Cp'-42 | Cp'-43 | Cp'-44 |
| 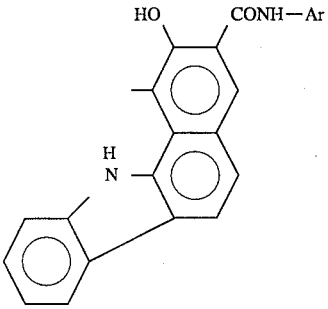 | Cp'-53 | Cp'-54 | Cp'-55 | Cp'-56 |

TABLE 3-continued
| | Ar | | | | |
|---|---|---|---|---|---|
| 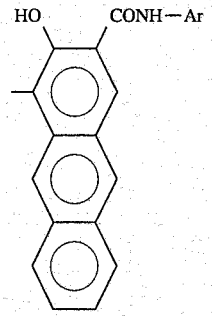 | Cp'-65 | Cp'-66 | Cp'-67 | Cp'-68 | |
| 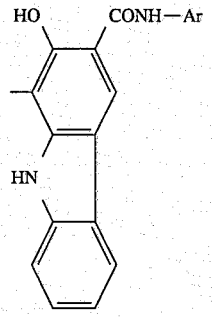 | Cp'-77 | Cp'-78 | Cp'-79 | Cp'-80 | |
| 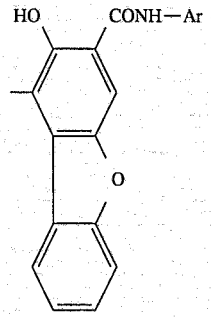 | Cp'-89 | Cp'-90 | Cp'-91 | Cp'-92 | |
| | 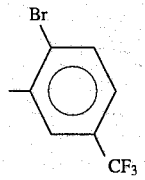 | 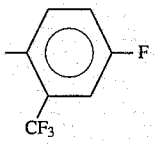 | 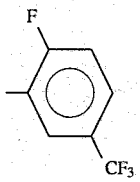 | 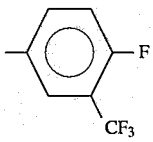 | 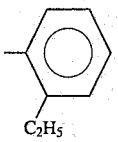 |
| 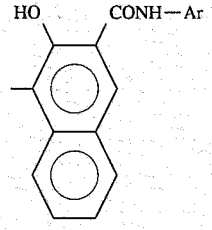 | Cp'-45 | Cp'-46 | Cp'-47 | Cp'-48 | Cp'-97 |

TABLE 3-continued
| Ar | | | | | |
|---|---|---|---|---|---|
| 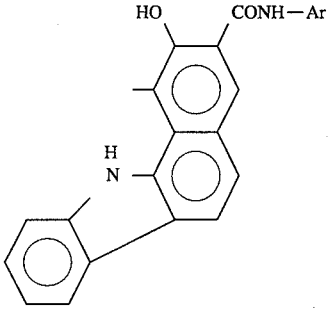 | Cp'-57 | Cp'-58 | Cp'-59 | Cp'-60 | Cp'-109 |
| 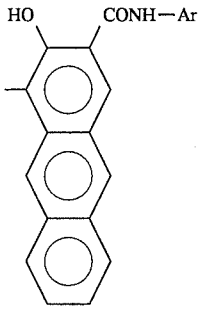 | Cp'-69 | Cp'-70 | Cp'-71 | Cp'-72 | Cp'-121 |
| 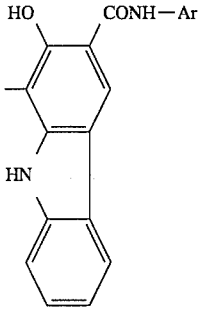 | Cp'-81 | Cp'-82 | Cp'-83 | Cp'-84 | Cp'-133 |
| 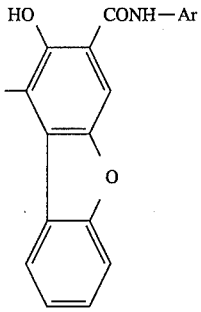 | Cp'-93 | Cp'-94 | Cp'-95 | Cp'-96 | Cp'-145 |
| | 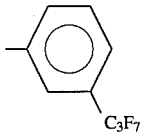 | 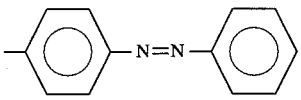 | 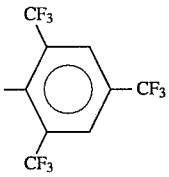 | 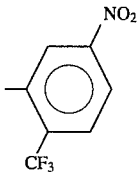 | |

TABLE 3-continued
| Ar | | | | |
|---|---|---|---|---|
| 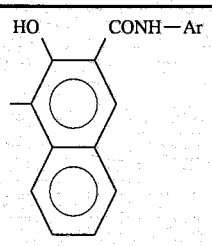 | Cp'-98 | Cp'-99 | Cp'-100 | Cp'-101 |
| 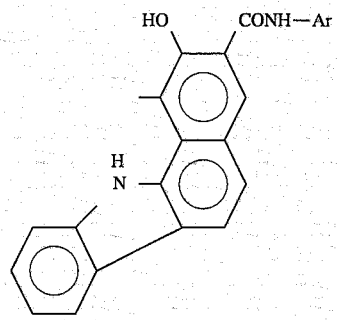 | Cp'-110 | Cp'-111 | Cp'-112 | Cp'-113 |
| 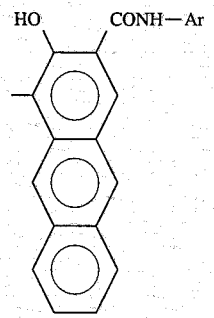 | Cp'-122 | Cp'-123 | Cp'-124 | Cp'-125 |
| 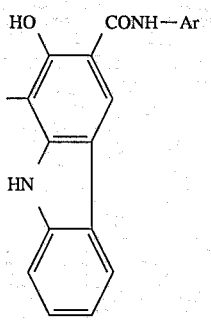 | Cp'-134 | Cp'-135 | Cp'-136 | Cp'-137 |
| 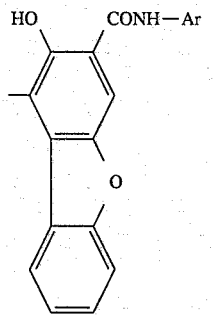 | Cp'-146 | Cp'-147 | Cp'-148 | Cp'-149 |

TABLE 3-continued
| | Ar | | | |
|---|---|---|---|---|
| | 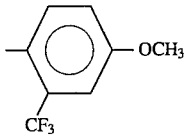 | 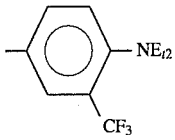 | 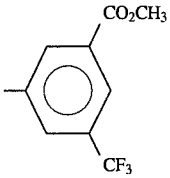 | 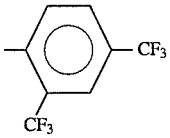 |
| 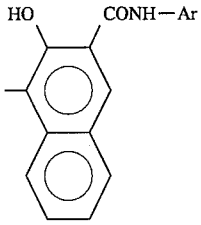 | Cp'-102 | Cp'-103 | Cp'-104 | Cp'-105 |
| 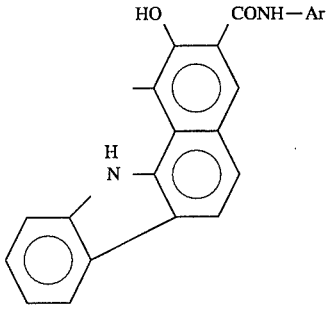 | Cp'-114 | Cp'-115 | Cp'-116 | Cp'-117 |
| 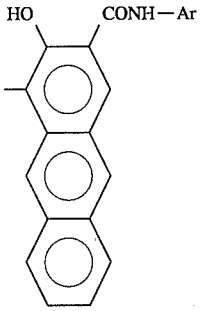 | Cp'-126 | Cp'-127 | Cp'-128 | Cp'-129 |
| 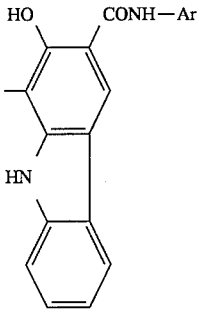 | Cp'-138 | Cp'-139 | Cp'-140 | Cp'-141 |

TABLE 3-continued
| Ar | | | | |
|---|---|---|---|---|
| 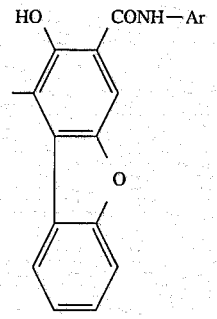 | Cp'-150 | Cp'-151 | Cp'-152 | Cp'-153 |
| | 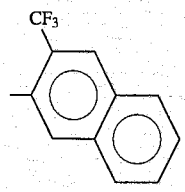 | 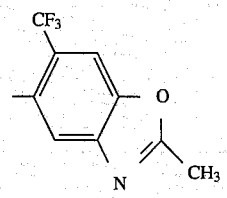 | 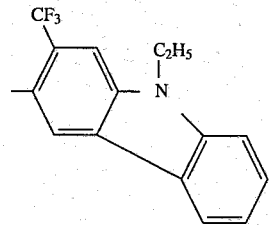 | |
| 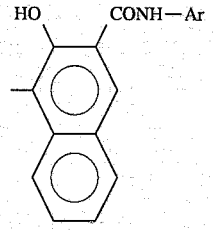 | Cp'-106 | Cp'-107 | Cp'-108 | |
| 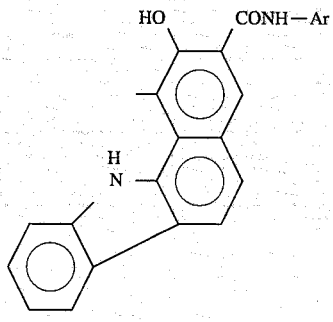 | Cp'-118 | Cp'-119 | Cp'-120 | |
| 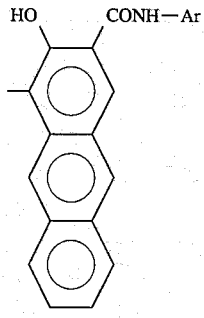 | Cp'-130 | Cp'-131 | Cp'-132 | |

TABLE 3-continued
| Ar | | | |
|---|---|---|---|
| 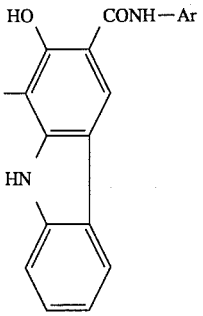 | Cp'-142 | Cp'-143 | Cp'-144 |
| 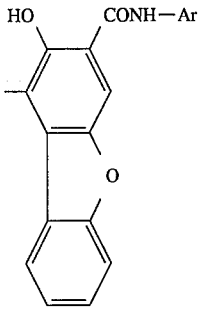 | Cp'-154 | Cp'-155 | Cp'-156 |
TABLE 4
| No. of Cp' | Cp' |
|---|---|
| (Cp'-157) | 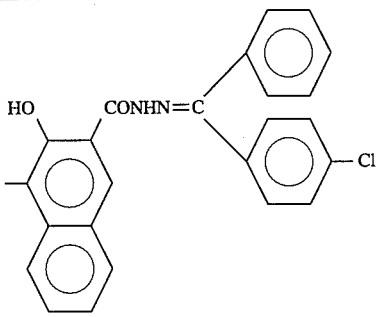 |
TABLE 4-continued
| No. of Cp' | Cp' |
|---|---|
| (Cp'-158) | 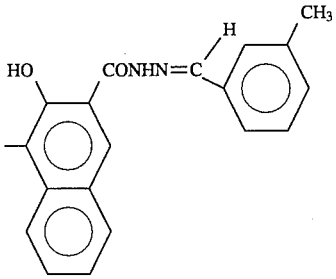 |
| (Cp'-159) | 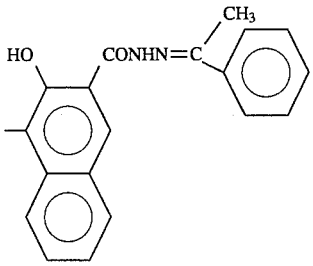 |

TABLE 4-continued
| No. of Cp' | Cp' |
|---|---|
| (Cp'-160) | 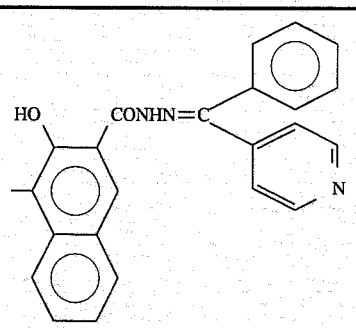 |
| (Cp'-161) | 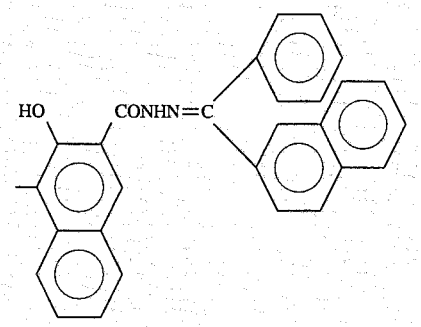 |
| (Cp'-162) | 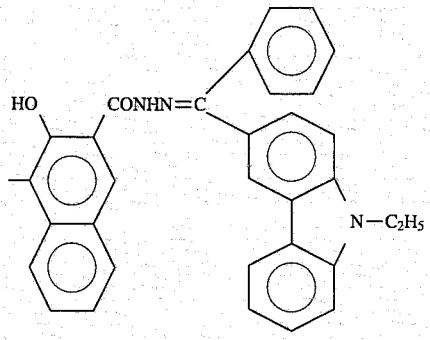 |
| (Cp'-163) | 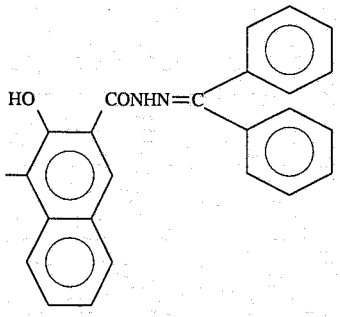 |
| (Cp'-164) | 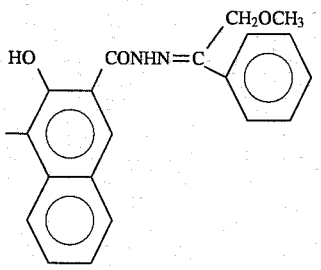 |
TABLE 4-continued
| No. of Cp' | Cp' |
|---|---|
| (Cp'-165) | 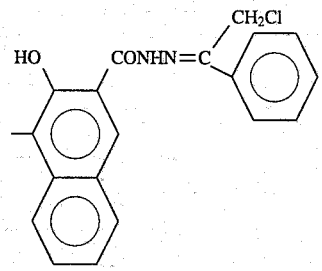 |
| (Cp'-166) | 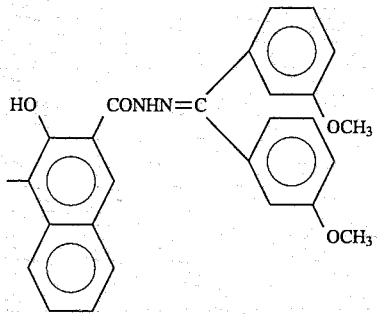 |
| (Cp'-167) | 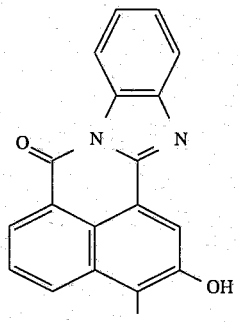 |
| (Cp'-168) | 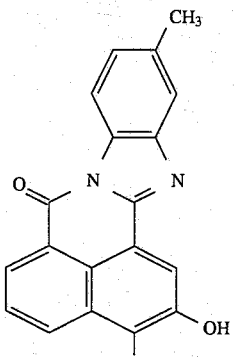 |
| (Cp'-169) | 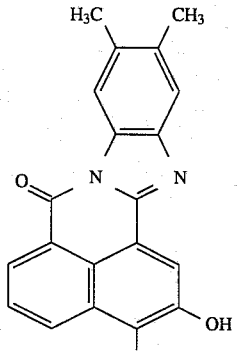 |

TABLE 4-continued
| No. of Cp' | Cp' |
|---|---|
| (Cp'-170) | 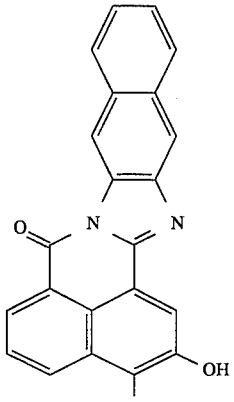 |
| (Cp'-171) | 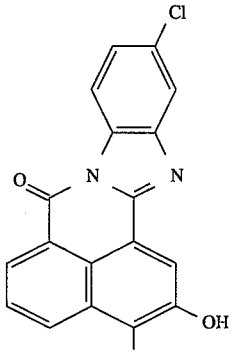 |
| (Cp'-172) | 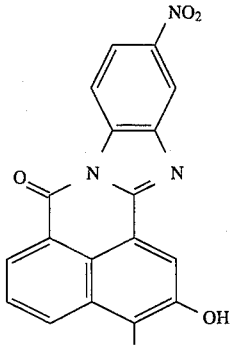 |
| (Cp'-173) | 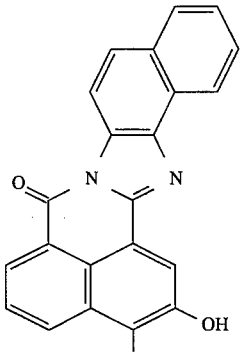 |
TABLE 4-continued
| No. of Cp' | Cp' |
|---|---|
| (Cp'-174) | 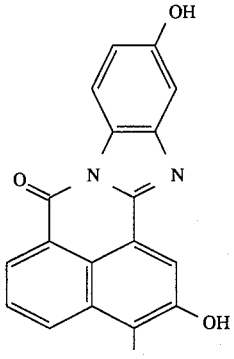 |
| (Cp'-175) | 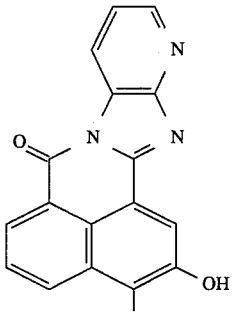 |
| (Cp'-176) | 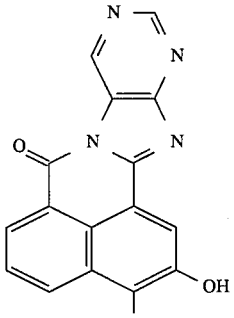 |
| (Cp'-177) | 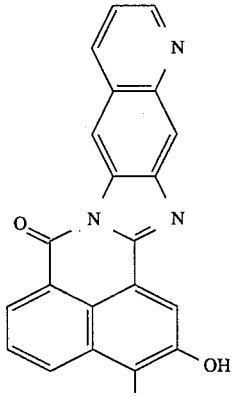 |

TABLE 4-continued

| No. of Cp' | Cp' |
|---|---|
| (Cp'-178) | 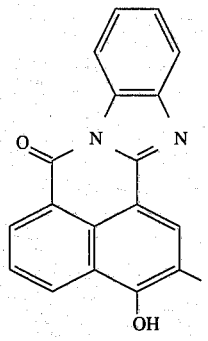 |
| (Cp'-179) | 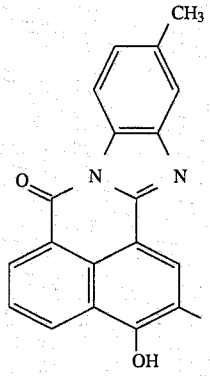 |
| (Cp'-180) | 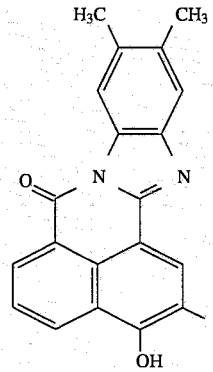 |
| (Cp'-181) | 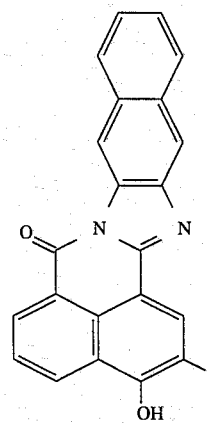 |

TABLE 4-continued

| No. of Cp' | Cp' |
|---|---|
| (Cp'-182) | 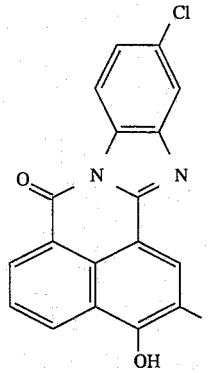 |
| (Cp'-183) | 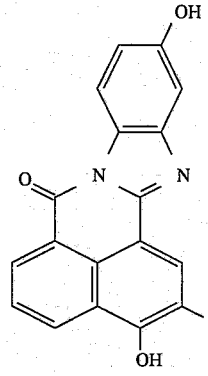 |
| (Cp'-184) | 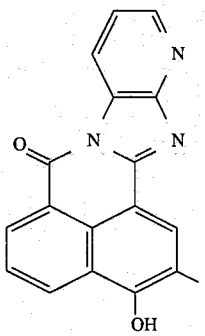 |

The preparation of the acetylene disazo compound represented by the general formula (I) can be accomplished by the following typical method. In particular, a diamino compound represented by the general formula (II) is tetrazolated by an ordinary method. The tetrazo compound is then allowed to undergo coupling reaction with a corresponding coupler in the presence of an alkali. Alternatively, after the tetrazonium salt is isolated in the form of borofluoride or zinc chloride complex salt, the material is then allowed to undergo coupling reaction with a coupler in a solvent such as N,N-dimethylformamide and dimethylsulfoxide in the presence of an alkali.

$$H_2N—Ar^1—C{=}C—Ar^2—NH_2 \quad \text{(II)}$$

wherein $Ar^1$ and $Ar^2$ have the same meaning as defined in the general formula (I).

The electrophotographic photoreceptor of the present invention comprises a photoconducting layer containing one or two disazo compounds represented by the general formula (I). Various forms of electrophotograpahic photoreceptors have been known. The electrophotographic photoreceptor of the present invention may be of any of these types. In general, the electrophotographic photoreceptor of the present invention is used in the following exemplified layer structures;

(1) layer structure comprising on an electrically conductive support an electrophotographic light-sensitive layer having a disazo compound dispersed in a binder or charge carrier-transporting medium;

(2) Layer structure comprising on an electrically conductive support a charge carrier-generating layer containing a disazo compound as main component and a charge carrier-transporting layer provided thereon; and (3) Layer structure comprising on an electrically conductive support a charge carrier-transporting layer and a charge carrier-generating layer containing a disazo compound as main component provided thereon.

The disazo compound of the present invention serves to generate charge carriers at an extremely high efficiency when it absorbs light. The charge carriers thus generated are then transported by charge carrier-transporting compounds.

The preparation of the electrophotographic photoreceptor of the type (1) can be accomplished by dispersing finely divided grains of a disazo compound in a binder solution or a solution containing a charge carrier-transporting compound and a binder, coating the dispersion on an electrically condutive support, and then drying the material. In this layer structure, the thickness of the electrophotographic light-sensitive layer is in the range of 3 to 30 μm, preferably 5 to 20 μm.

The preparation of the electrophotographic photoreceptor of the type (2) can be accomplished by vacuum-depositing on an electrically conductive support a disazo compound to form a charge carrier-generating layer or coating on an electrically conductive support a dispersion of finely divided grains of a disazo compound in a proper solvent containing a binder resin dissolved therein, and then drying the material to form a charge carrier-generating layer thereon, and optionally finishing the surface thereof by buffing or adjusting the thickness thereof, coating a solution of a charge carrier-transporting substance and binder resin thereon, and then drying the material. In this layer structure, the thickness of the charge carrier-generating layer thus formed is in the range of 0.1 to 4 μm, preferably 0.1 to 2 μm, and the thickness of the charge carrier-transporting layer is in the range of 3 to 30 μm, preferably 5 to 20 μm.

The preparation of the electrophotographic photoreceptor of the type (3) can be accomplished by reversing the order of lamination of the charge carrier-generating layer and the charge carrier-transporting layer in the electrophotographic photoreceptor of the type (2).

The disazo compound to be incorporated in the electrophotographic photoreceptor of the type (1), (2) or (3) is ground and dispersed by means of a known dispersing machine such as ball mill, sand mill, and oscillating mill to a grain diameter of 0.1 μm to 2 μm, preferably 0.3 to 2 μm.

If the content of the disazo compound in the electrophotographic photoreceptor of the type (1) is too small, it causes a deterioration in sensitivity. If this value is too large, it causes a deterioration in chargeability and a deterioration in the strength of the electrophotographic light-sensitive layer. The content of the disazo compound in the electrophotographic light-sensitive layer is in the range of 0.01 to 2 times by weight, preferably 0.05 to 1 time by weight that of the binder. The content of the charge carrier-transporting compound in the electrophotographic light-sensitive layer is in the range of 0.1 to 2 time by weight, preferably 0.3 to 1.5 times by weight that of the binder. The content of a charge carrier-transporting compound which can be used as binder itself is preferably in the range of 0.01 to 0.5 time by weight that of the charge carrier-transporting compound.

If the electrophotographic photoreceptors of the types (2) and (3) comprise a disazo compound-containing layer as charge carrier-generating compound-containing layer, the content of the disazo compound is preferably in the range of 0.1 or more times by weight that of the binder. If this value falls below this range, a sufficient sensitivity cannot be obtained. Even if there are contained no binders, such a system can be used. The proportion of the charge carrier-transporting compound in the charge carrier-transporting compound-containing layer is in the range of 0.2 to 2 times by weight, preferably 0.3 to 1.5 times by weight that of the binder. If a high molecular charge carrier-transporting compound which can be used as binder itself is used, such a system can be used free of other binders.

Examples of electrically conductive support to be incorporated in the present electrophotographic photoreceptor include plate of metal such as aluminum, copper, and zinc, support material obtained by vacuum-depositing or dispersion-coating an electrically conductive material such as aluminum, indium oxide, tin oxide and copper iodide on sheet or film of plastic such as polyester, and paper treated with an electrically conductive material such as inorganic salt, e.g., sodium chloride and calcium chloride, and organic quaternary ammonium salt.

As binder there may be preferably used a high dielectric constant hydrophobic insulating film-forming high molecular polymer.

Specific examples of such a high molecular polymer include polycarbonate, polyester, polyester carbonate, polysulfone, methacrylic resin, acrylic resin, polyvinyl chloride, polyvinylidene chloride, polystyrene, polyvinyl acetate, styrene-butadiene copolymer, vinylidene chloride-acrylonitrile copolymer, vinyl chloride-vinyl acetate copolymer, vinyl chloride-vinyl acetate-maleic anhydride copolymer, silicon resin, silicon-alkyd resin, phenol-formaldehyde resin, styrene-alkyd resin, styrene-maleic anhydride copolymer, phenoxy resin, polyvinylbutyral resin, and poly-N-vinyl carbazole. However, the present invention should not be construed as being limited to these polymers.

These resin binders can be used singly or in admixture.

In the photoreceptors of the present invention, a plasticizer can be used in admixture with a resin binder.

Examples of such a plasticizer include biphenyl, biphenyl chloride, o-terphenyl, p-terphenyl, dibutyl phthalate, dimethyl glycol phthalate, dioctyl phthalate, triphenyl phosphate, chlorinated paraffin, and dilauryl thiodipropinoate.

In the preparation of the present electrophotographic photoreceptor, there can be used additives such as sensitizer.

Examples of sensitizers to be used in the present invention include triallylmethane dye such as Brilliant Green, Victorian Blue B, Methyl Violet, Crystal Violet, and Acid Violet 6B, xanthene dye such as Rhodamine B, Rhodamine 6G, Rhodamine G Extra, Eosine S, Erythrosine, Rose Bengal, and Fluorescein, thiazine dye such as Methylene Blue, astrazone dye such as C.I.Basic. Violet 7 (C.I.48020), cyanine dye, and pyrilium dye such as 2,6-diphenyl-4-(N,N-dimethylaminophenyl)thiapyrilium perchlorate, and benzopyrilium salt (as disclosed in JP-B-48-25658).

In addition, a silicone oil, fluorine surface active agent or the like can be incorporated in the electrophotographic photoreceptor to improve the surface properties thereof.

The charge carrier-transporting material to be incorporated in the charge carrier-transporting layer in the electrophotographic photoreceptor of the present invention can be classified into two types: electron-transporting compound and positive hole-transporting compound. The electrophotographic photoreceptor of the present invention can comprise both the two types of charge carrier-transporting materials.

Examples of such an electron-transporting compound include compounds containing electron attractive group, such as 2,4,7-trinitro-9-fluorenone, 2,4,5,7-tetranitro-9-fluorenone, 9-dicyanomethylene-2,4,7-trinitrofluorenone, 9-dicyanomethylene-2,4,5,7-tetranitrofluorenone, tetranitrocarbazole, chloranil, 2,3-dichloro-5,6-dicyanobenzoquinone, 2,4,7-trinitro-9,10-phenanthrequinone, tetrachlorophthalic anhydride, tetracyanoethylene, and tetracyanoquinonedimethane.

Examples of compounds transporting positive holes include compounds containing electron-donating group. Examples of high molecular compounds containing electron-donating group include:

(a) Polyvinyl carbazole and its derivatives as disclosed in JP-B-34-10966;

(b) Vinyl polymers such as polyvinyl pyrene, polyvinyl anthracene, poly-2-vinyl-4-(4'-dimethylaminophenyl)-5-phenyloxazole and poly-3-vinyl-N-ethylcarbazole, as diclosed in JP-B-43-18674 and JP-B-3-19192;

(c) Polymers such as polyacenaphthylene, polyindene and acenaphthylene-styrene copolymer, as disclosed in JP-B-43-19193;

(d) Condensed resin such as pyrene-formaldehyde resin, bromopyrene-formaldehyde resin and ethylcarbazole-formaldehyde resin, as disclosed in JP-B-56-13940; and (e) Various triphenylmethane polymers as disclosed in JP-A-56-90883 and JP-A-56-161550.

Examples of low molecular compounds containing electron-donating group include:

(f) Triazole derivatives as disclosed in U.S. Pat. No. 3,112,197;

(g) Oxadiazole derivatives as disclosed in U.S. Pat. No. 3,189,447;

(h) Imidazole derivatives as disclosed in JP-B-37-16096;

(i) Polyarylalkane derivatives as disclosed in U.S. Pat. Nos. 3,615,402, 3,820,989, and 3,542,544, JP-B-45-555, and JP-B-51-10983, and JP-A-51-93224, JP-A-55-108667, JP-A-55-156953, and JP-A-56-36656;

(j) Pyrzolidone derivatives and pyrazolone derivatives as disclosed in U.S. Pat. Nos. 3,180,729, and 4,278,746, and JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546;

(k) Phenylenediamine derivatives as disclosed in U.S. Pat. No. 3,615,404, JP-B-51-10105, JP-B-46-3712, and JP-B-47-28336, and JP-A-54-83435, JP-A-54-110836, and JP-A-54-119925;

(l) Arylamine derivatives as disclosed in U.S. Pat. Nos. 3,567,450, 3,180,703, 3,240,597, 3,658,520, 4,232,103, 4,175,961, and 4,012,376, West German Patent (DAS) 1110518, JP-A-55-144250, JP-A-56-119132, JP-A-56-119132, and JP-A-56-22437, and JP-B-49-35702 and JP-B-39-27577;

(m) Amino-substituted chalcone derivatives as disclosed in U.S. Pat. No. 3,526,501;

(n) N,N-bicarbazyl derivatives as disclosed in U.S. Pat. No. 3,542,546;

(o) Oxazole derivatives as disclosed in U.S. Pat. No. 3,257,203;

(p) Styrylanthracene derivatives as disclosed in JP-A-56-46234;

(q) Fluorenone derivatives as disclosed in JP-A-54-110837;

(r) Hydrazone derivatives as disclosed in U.S. Pat. No. 3,717,462, and JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144;

(s) Benzidine derivatives as disclosed in U.S. Pat. Nos. 4,047,948, 4,047,949, 4,265,990, 4,273,846, 4,299,897, and 4,306,008; and (t) Stilbene derivatives as disclosed in JP-A-58-190953, JP-A-59-95540, JP-A-59-97148, JP-A-59-195658 and JP-A-62-36674.

In the present invention, the charge carrier-transporting compound is not limited to the above mentioned compounds (a) to (t). Any known charge carrier-transporting compound can be used in the present invention.

In the preparation of the electrophotographic photoreceptor of the present invention, a charge-transporting compound can be incorporated in the charge-generating layer.

In the present invention, an adhesive layer or barrier layer can be optionally provided between the electrically conductive support and the light-sensitive layer. As materials for such an adhesive layer or barrier layer there can be used the above mentioned polymers used as resin binder. In addition, there can be used gelatin, casein, polyvinyl alcohol, ethyl cellulose, carboxymethyl cellulose, vinylidene chloride polymer latex as disclosed in JP-A-59-84247, styrene-butadiene polymer latex as disclosed in JP-A-59-114544, or aluminum oxide. The thickness of such a layer is preferably in the range of 1 μm or less.

The photoreceptors thus obtained can be optionally subjected to process for inhibition of interference fringe which may occur when an interference light such as laser is used for exposure. Examples of such an inhibition process include a process which comprises providing an undercoat layer having a light-scattering reflective surface as disclosed in JP-A-60-186850, a process which comprises providing an undercoat layer containing titanium black as disclosed in JP-A-60-184258, a process which allows the charge carrier-generating layer to absorb the majority of light from the light source used as disclosed in JP-A-58-82249, a process which comprises providing a charge carrier-transporting layer having a microphase separation structure as disclosed in JP-A-61-18963, a process which comprises incorporating in the photoconducting layer a substance which absorbs or scatters an interference light as disclosed in JP-A-60-86550, a process which comprises providing on the surface of the photoreceptor an indentation having a depth of one forth or more of the wavelength of an interference light as disclosed in JP-A-63-106757, and a process which comprises providing a light-scattering layer or light-absorbing layer on the back side of a transparent support as disclosed in JP-A-62-172371 and JP-A-62-174771.

The electrophotographic photoreceptor of the present invention has been described in detail. The electrophotographic photoreceptor of the present invention is normally characterized by a high sensitivity and a small change in the electrophotographic properties upon repeated use.

The electrophotographic photoreceptor of the present invention can be widely applied in fields other than electrophotographic copiers, such as printers using laser, cathode ray tube, LED or the like as light source.

The photoconducting composition containing a disazo compound of the present invention can be used as photoconducting layer used in video camera's pickup tube or photoconducting layer in a solid-state imaging device having an image-receiving layer (photoconducting layer) provided on the entire surface of one-dimensionally or two-dimensionally arranged semiconductor circuit for transferring or scattering signal. Furthermore, the photoconducting composition of the present invention can be used as photoconducting layer used in solar cells as described in A. K. Gosch and Tomfeng, "Journal of Applied Physics", 49(12), 5982(1978).

The disazo compound of the present invention can also be used as photoconducting coloring grain for use in photoelectrophoresis system or coloring grain for dry or wet electrophotographic developer.

As disclosed in JP-B-37-17162, and JP-A-55-19063, JP-A-55-161250 and JP-A-57-147656, the disazo compound of the present invention can also be dispersed in an alkali-soluble resin such as phenol resin with the above mentioned charge carrier-transporting compound such as oxadiazole derivative and hydrazine derivative, coated on an electrically conductive support such as aluminum, dried, imagewise exposed to light, toner-developed, and then etched with an alkaline aqueous solution to obtain a high resolution, high durability and high sensitivity printing plate or printed circuit.

The proportion of binding resin to charge-transporting substance in the electrophotographic printing plate precursor of the present invention may be such that the charge-transporting substance can be solved in the binding resin and is not deposited. If the content of the charge-transporting substance is too small, the sensitivity is lowered. Therefore, the content of the charge-transporting substance is normally in the range of 0.05 to 3 parts by weight, preferably 0.1 to 1.5 parts by weight based on 1 part by weight of binding resin. If the content of the charge-generating substance is too great, the charge retention is deteriorated. On the contrary, if the content of the charge-generating substance is too small, the sensitivity is lowered. Therefore, the content of the charge-generating substance in the photoreceptor is normally in the range of 0.01 to 2 parts by weight, preferably 0.05 to 1 part by weight based on 1 part by weight of binding resin. If the thickness of the photoconductive insulating layer is too small, it cannot catch charge required for development. If the thickness of the photoconductive insulating layer is too great, it is subject to side etching in the etching process, making it impossible to obtain excellent images. Therefore, the thickness of the photoconductive insulating layer is normally in the range of 0.1 to 30 μm, preferably 0.5 to 10 μm.

The electrophotographic printing plate precursor of the present invention can be obtained by coating a photoconductive insulating layer on an electrically conductive substrate. The coating solution is prepared by grinding and dispersing a charge-generating substance in a proper solvent to a grain diameter of 0.1 to 5 μm by means of a dispersing machine such as ball mill, paint shaker, dinomill and attritor. The binding resin, charge carrier-transporting compound and other additives to be incorporated in the photoconducting layer can be added to the system during or after dispersion of the charge-generating substance. The coating solution thus obtained can be coated on the substrate by a known method such as rotary coating, blade coating, knife coating, reverse roll coating, dip coating, rod bar coating and spray coating, and then dried to obtain an electrophotographic printing plate precursor. As solvent for the coating solution there can be used halogenated hydrocarbon such as dichloromethane, dichloroethane and chloroform, alcohol such as methanol and ethanol, ketone such as acetone, methyl ethyl ketone and cyclohexanone, glycol ether such as ethylene glycol monomethyl ether, 2-methoxyethyl acetate and dioxane, and ester such as ethyl acetate and butyl acetate.

The electrophotographic printing plate precursor of the present invention may optionally comprise a sensitizer, a plasticizer, and a surface active agent for improving film properties.

Examples of such a sensitizer include chloranil, tetracyanoethylene, Methyl Violet, Rhodamine B, cyanine dye, melocyanine dye, pyrilium dye, and thiapyrilium dye.

Examples of such a plasticizer include biphenyl, biphenyl chloride, o-terphenyl, p-terphenyl, dibutyl phthalate, dimethyl glycol phthalate, dioctyl phthalate, triphenyl phosphate, methyl naphthaline, benzophenone, chlorinated paraffin, polypropyrene, polystyrene, dilauryl thiodipropinoate, 3,5-dinitrosalicylic acid, and various fluorohydrocarbons.

As the electrically condutive substrate to be used in the electrophotographic printing plate precursor of the present invention there can be used a plastic sheet having an electrically condutive surface, solvent-impermeable or electrically conductive paper, aluminum plate, zinc plate, or electrically conductive substrate having a hydrophilic surface such as bimetal plate, e.g., copper-aluminum plate, copper-stainless steel plate and chromium-copper plate, and trimetal plate, e.g., chromium-copper-aluminum plate, chromium-lead-iron plate and chromium-copper-stainless steel plate. The thickness of the electrically condutive substrate is preferably in the range of 0.1 to 3 mm, particularly 0.1 to 1 mm.

The support having an aluminum surface is preferably subjected to surface treatment such as graining, immersion in an aqueous solution of sodium silicate, potassium fluorinated zirconiumate, phosphate or the like and anodization. Furthermore, an aluminum plate which has been grained and dipped in an aqueous solution of sodium silicate as disclosed in U.S. Pat. No. 2,714,066 and an aluminum plate which has been anodized and dipped in an aqueous solution of silicate of alkaline metal as disclosed in JP-B-47-5125 can be commonly used.

The anodization of the aluminum plate can be accomplished by passing electric current through an aluminum plate as anode in an electrolyte such as aqueous solution or nonaqueous solution of inorganic acid, e.g., phosphoric acid, chromic acid, sulfuric acid and boric acid, organic acid, e.g., oxalic acid and sulfamic acid or salt thereof, singly or in combination.

A silicate electrodeposition method as disclosed in U.S. Pat. No. 3,658,662 can be effectively used. A treatment with a polyvinylsulfonic acid as disclosed in West German Patent (OLS) No. 1,621,478 can also be effectively used.

These treatments are effected for the purpose of rendering the surface of the support hydrophilic as well as inhibiting undesirable reaction with a photoconducting insulating layer provided thereon or improving adhesion to the photoconducting insulating layer.

In the electrophotographic printing plate precursor of the present invention, an overcoat layer which can be dissolved during the removal of the photoconductive insulating layer may be optionally provided on the photoconductive insulating layer for the purpose of improving the static properties of the photocondutive insulating layer, the developability during toner development or the image properties. The overcoat layer may be a mechanically matted layer or a resin layer containing a matting agent. Examples of such a matting agent include silicon dioxide, zinc oxide, titanium oxide, zirconium oxide, glass grain, alumina, starch, grain of polymer such as polymethyl methacrylate, polystyrene and phenolic resin, and matting agents as described in U.S. Pat. Nos. 2,710,245, and 2,992,101. These matting agents can be used in combination. The resin to be incorporated in the resin layer containing such a matting agent can be properly selected depending on the etching solution used. Specific examples of such a resin include gum arabic, glue, gelatin, casein, cellulose (e.g., biscose, methyl cellulose, ethyl cellulose, hydroxyethyl cellulose, hydroxypropylmethyl cellulose, carboxymethyl cellulose), starch (e.g., soluble starch, denatured starch), polyvinyl alcohol, polyethylene oxide, polyacrylic acid, polyacrylamide, polyvinyl methyl ether, epoxy resin, phenolic resin (particularly novolak resin), polyamide, and polyvinyl butyral. Two or more of these resins can be used in combination.

The electrophotographic printing plate precursor of the present invention can optionally comprise an alkali-soluble interlayer made of casein, polyvinyl alcohol, ethyl cellulose, phenolic resin, styrene-maleic anhydride copolymer, polyacrylic acid or the like between the electrically conductive support and the photoconductive insulating layer for the purpose of improving the adhesion therebetween and the static characteristics of the photoconductive insulating layer.

The electrophotographic printing plate of the present invention can be normally prepared by known processes. In particular, the electrophotographic printing plate precurosr is substantially uniformly charged in a dark place, and then imagewise exposed to light to form a static image thereon. As the exposure process there can be used scanning exposure using semiconductor laser, He—Ne laser or the like as light source, reflected image exposure using xenon lamp, tungsten lamp, fluorescent tube or the like as light source or contact exposure through a transparent positive film. Subsequently, the static latent image is developed with a toner. As the development process there can be used any known method such as cascade development, magnetic brush development, powdered cloud development and liquid development. Among these development processes, the liquid development process enables the formation of fine images and thus is suitable for the preparation of printing plate. The toner image thus formed can be fixed by any known fixing method such as heat fixing, pressure fixing and solvent fixing. The toner image thus fixed can be then allowed to serve as resist upon the removal of the photocondutive insulating layer from the nonimage portion with an etching solution to prepare a printing plate.

As the etching solution to be used for the printing plate precursor of the present invention there can be used an alkaline aqueous solution or a mixture thereof with an organic solvent miscible therewith. Such an alkaline aqueous solution preferably exhibis a pH value of 9 or more, preferably 10 to 13.5. Specific examples of such an alkaline aqueous solution include aqueous solutions of sodium hydroxide, potassium hydroxide, sodium carbonate, sodium silicate, potassium silicate, sodium methasilicate, potassium methasilicate, sodium phosphate, potassium phosphate, ammonia, and aminoalcohol such as monoethanolamine, diethanolamine and triethanolamine. Examples of such an organic solvent miscible with the alkaline aqueous solution include alcohol, ketone, ester and ether. Examples of such an alcohol include lower and aromatic alcohol such as methanol, ethanol, propanol, butanol, benzyl alcohol, and phenethyl alcohol, cellusolve such as ethylene glycol, diethylene glycol, triethylene glycol, and polyethylene glycol, and aminoalcohol such as monoethanolamine, diethanolamine, and triethanolamine.

Examples of such a ketone include acetone, methyl ethyl ketone, and methyl isobutyl ketone.

Examples of such an ester include ethyl acetate, isopropyl acetate, n-propyl acetate, sec-butyl acetate, isobutyl acetate, n-butyl acetate, 1-acetoxy-2-methoxyethane, and ethylene glycol diacetate. Examples of such an ether include ethyl ether, tetrahydrofuran, dixane, 2-methoxyethanol, and ethylene glycol dimethyl ether. Such an organic solvent can be mixed with the alkaline aqueous solution in an arbitrary proportion, preferably 90% by weight or less based on the mixed solution. To the etching solution may be added a surface active agent, an anti-foaming agent, a coloring agent or the like as necessary.

The toner to be used for the printing plate precursor of the present invention may preferably comprise a resin component resistive to the etching solution. Examples of such a resin component include acrylic resin made of methacrylic acid, methacrylic ester, etc., vinyl acetate resin, copolymer of vinyl acetate and ethylene or vinyl chloride, vinyl chloride resin, vinylidene chloride resin, vinyl acetal resin such as polyvinyl butyral, copolymer of polystyrene, styrene, etc. with butadiene, methacrylic ester, etc., polyethylene, polypropyrene and chlorinated compound thereof, polyeseter resin (e.g., polyethylene terephthalate, polyethylene isophthalate, polycarbonate of bisphenol A), polyamide resin (e.g., polycapramide, polyhexamethylenazipoamide, polyhexamethylene sebacamide), phenolic resin, xylene resin, alkyd resin, vinyl-modified alkyd resin, gelatin, cellulose ester derivative such as carboxymethyl cellulose, wax, and polyolefin.

When the printing plate precursor of the present invention is used, the relationship between the toner and the electrically conductive substrate should be such that the former is lipophilic and the latter is hydrophilic. In this case, their degree of lipophilicity and hydrophilicity are relative. The oil printing ink repellency of the surface of the substrate means that when the toner image portion and the exposed surface of the substrate are adjacent to each other, an oil printing ink must not be attached to and retained on the surface of the substrate. The hydrophilicity of the surface of the substrate means that when the toner image portion and the exposed surface of the substrate are adjacent to each other, the surface of the substrate must not be too water-repellent to retain water. The lipophilicity of the toner means that the toner must not be too repellent to oil printing ink to retain an oil printing ink. The surface of the electrically conductive substrate may be repellent to an oil printing ink and to water (hydrophobic).

The present invention will be further described in the following examples hereinafter, but the present invention should not be construed as being limited thereto.

EXAMPLE 1

5 parts by weight of a disazo compound represented by Compound Group (1) in Table 1 wherein Cp' is (Cp'-21) in Table 2 and 5 parts by weight of a polyester resin (Vylon 200, available from Toyobo Co., Ltd.) were added to 50 parts by weight of tetrahydrofuran. The mixture was then subjected to dispersion by means of a ball mill for 12 hours. The dispersion thus prepared was coated on an electrically condutive support (Metalme 75TS available from Toray Industries Inc.; obtained by vacuum-depositing aluminum on a 75-μm thick polyethylene terephthalate support) by means of a wire round rod, and then dried to obtain a charge-generating layer having a thickness of about 0.5 μm.

On the charge-generating layer was coated a solution of a mixture of 3.6 parts by weight of p-(diphenylamino)benzaldehyde-N'-methyl-N'-phenylhydrazone of the following general formula:

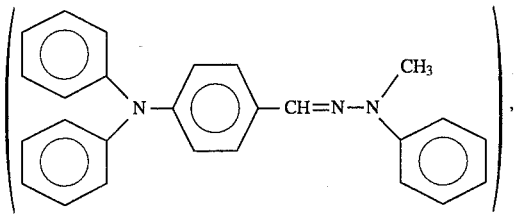

4 parts by weight of a polycarbonate resin (Panlite K-1300 available from Teijin Limited), 13.3 parts by weight of dichloromethane and 26.6 parts by weight of 1,2-dichloroethane by means of an applicator to form a 17-μm thick charge-transporting layer thereon. Thus, an electrophotographic photoreceptor comprising a light-sensitive layer consisting of two layers was prepared.

The electrophotographic photoreceptor thus prepared was then measured for electrophotographic properties by means of a static copying paper tester (Model SP-428 available from Kawaguchi Denki K.K.) in a static process. Specifically, the photoreceptor was first measured for initial surface potential Vs when corona-charged at −6 kv and surface potential Vo developed after being stored in a dark place for 30 seconds. The photoreceptor was then exposed to light from a tungsten lamp in such a manner that the illuminance on the surface of the photoreceptor reached 3 lux. The photoreceptor was then measured for exposure $E_{50}$ required for surface potential to be halved and surface potential developed after exposed for 30 seconds (residual potential $V_R$). These measurements were repreated over 3,000 times. The results are set forth in Table 5.

TABLE 5

| | 1st time | 3,000th time |
|---|---|---|
| $E_{50}$ [lux · sec] | 1.1 | 1.2 |
| Vs [−V] | 910 | 880 |
| Vo [−V] | 770 | 730 |
| $V_R$ [−V] | 0 | 10 |

EXAMPLES 2–18

Two-layer electrophotographic photoreceptors were prepared in the same manner as in Example 1 except that the disazo compound was replaced by disazo compounds as set forth in Table 6, respectively. These specimens were measured for $E_{50}$, Vs, Vo and $V_R$ in the same manner as in Example 1. The results are set forth in Table 6.

COMPARATIVE EXAMPLES 1–3

Comparative two-layer electrophotographic photoreceptors were prepared in the same manner as in Example 1 except that the disazo compound was replaced by disazo compounds H-1, H-2 and H-3 having the following general formulae, respectively. These specimens were measured for $E_{50}$, Vs, Vo and $V_R$ in the same manner as in Example 1. The results are set forth in Table 7.

(H-1)

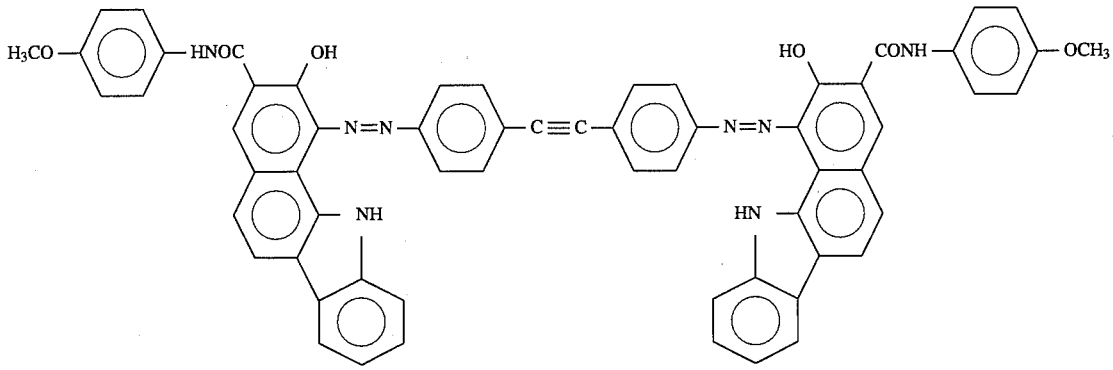

(H-2)

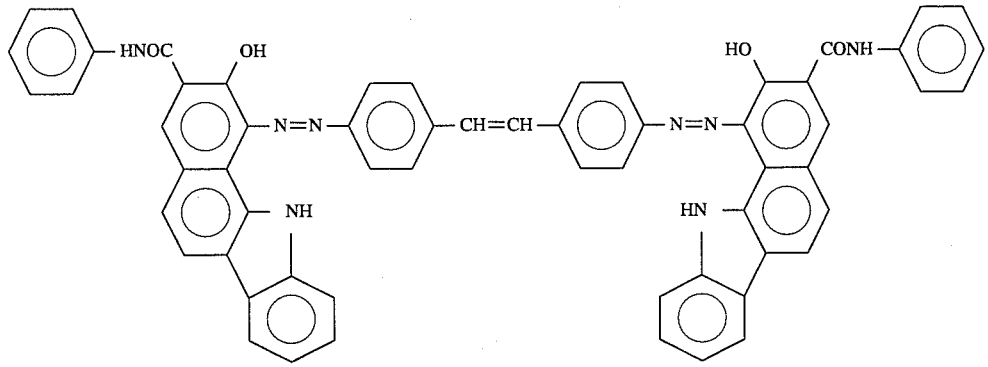

-continued (H-3)

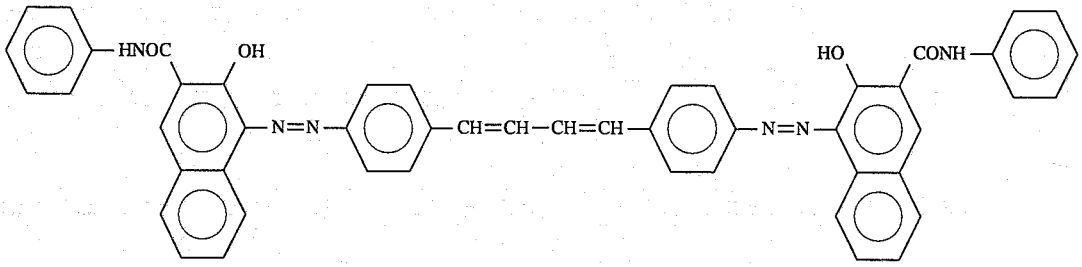

TABLE 6

| Example No. | Diazo Compound: Compound Group No. | Cp' | No. | 1st Time $E_{50}$ (lux · sec) | 1st Time $V_s$ (−V) | 1st Time $V_o$ (−V) | 1st Time $V_R$ (−V) | 3,000th Time $E_{50}$ (lux · sec) | 3,000th Time $V_S$ (−V) | 3,000th Time $V_O$ (−V) | 3,000th Time $V_R$ (−V) |
|---|---|---|---|---|---|---|---|---|---|---|---|
| 2 | (1) | (Cp' | −1) | 1.5 | 930 | 810 | 0 | 1.5 | 910 | 790 | 0 |
| 3 | (1) | (Cp' | −22) | 1.1 | 980 | 740 | 0 | 1.2 | 950 | 710 | 0 |
| 4 | (1) | (Cp' | −53) | 1.2 | 940 | 790 | 10 | 1.2 | 930 | 770 | 20 |
| 5 | (2) | (Cp' | −21) | 1.7 | 980 | 850 | 0 | 1.8 | 940 | 820 | 5 |
| 6 | (2) | (Cp' | −22) | 1.5 | 890 | 770 | 20 | 1.5 | 850 | 750 | 30 |
| 7 | (2) | (Cp' | −111) | 1.3 | 920 | 820 | 0 | 1.3 | 900 | 790 | 0 |
| 8 | (6) | (Cp' | −26) | 1.1 | 940 | 850 | 10 | 1.2 | 920 | 810 | 10 |
| 9 | (7) | (Cp' | −51) | 1.7 | 960 | 750 | 0 | 1.8 | 930 | 700 | 0 |
| 10 | (9) | (Cp' | −6) | 2.0 | 900 | 800 | 0 | 2.0 | 850 | 760 | 0 |
| 11 | (10) | (Cp' | −21) | 1.6 | 930 | 820 | 0 | 1.8 | 910 | 780 | 0 |
| 12 | (12) | (Cp' | −3) | 1.0 | 860 | 780 | 0 | 1.1 | 820 | 720 | 0 |
| 13 | (19) | (Cp' | −22) | 1.2 | 920 | 710 | 0 | 1.4 | 900 | 680 | 0 |
| 14 | (20) | (Cp' | −22) | 1.3 | 890 | 720 | 0 | 1.3 | 850 | 700 | 0 |
| 15 | (20) | (Cp' | −34) | 1.8 | 940 | 800 | 10 | 1.8 | 920 | 760 | 20 |
| 16 | (20) | (Cp' | −24) | 1.7 | 940 | 840 | 0 | 1.8 | 920 | 790 | 5 |
| 17 | (21) | (Cp' | −4) | 1.5 | 970 | 880 | 0 | 1.6 | 950 | 850 | 0 |
| 18 | (23) | (Cp' | −111) | 1.1 | 860 | 730 | 0 | 1.2 | 850 | 690 | 0 |

TABLE 7

| Comparative Example No. | Diazo Compound No. | 1st Time $E_{50}$ (lux · sec) | 1st Time $V_s$ (−V) | 1st Time $V_o$ (−V) | 1st Time $V_R$ (−V) | 3,000th Time $E_{50}$ (lux · sec) | 3,000th Time $V_S$ (−V) | 3,000th Time $V_O$ (−V) | 3,000th Time $-V_R$ (−V) |
|---|---|---|---|---|---|---|---|---|---|
| 1 | H-1 | 3.0 | 900 | 770 | 15 | 4.2 | 860 | 690 | 30 |
| 2 | H-2 | 3.2 | 920 | 790 | 20 | 4.1 | 870 | 720 | 40 |
| 3 | H-3 | 5.1 | 880 | 680 | 30 | 7.0 | 800 | 590 | 50 |

The results of Examples 1 to 18 and Comparative Examples 1 to 3 show that the electrophotographic photoreceptors of the present invention exhibit excellent sensitivity and repeatability as compared to the comparative electrophotographic photoreceptors.

EXAMPLE 19

On an electrically conductive support comprising a polyethylene terephthalate film having an aluminum film vacuum-deposited thereon was coated a solution of 7.5 parts by weight of a hydrazone compound as set forth in Example 1 and 10 parts by weight of a polycarbonate of bisphenol A in 50 parts by weight of dichloromethane by means of a wire round rod. The material was then dried to prepare a 12-μ thick charge-transporting layer.

2 parts by weight of a disazo compound as used in Example 1 and 2 parts by weight of a polyester resin (Vylon 200 available from Toyoho Co., Ltd.) were dissolved in 5 parts by weight of chlorobenzene. The solution was then subjected to dispersion by means of a paint shaker for 1 hour. The dispersion was coated on the charge-transporting layer by means of a wire round rod, and then dried to form a 1-μm thick charge-generating layer thereon. Thus, a positive charging electrophotographic photoreceptor comprising an electrophotographic light-sensitive layer consisting of two layers was prepared.

The electrophotographic photoreceptor thus prepared was then measured for electrophotographic properties by means of a static copying paper tester (Model SP-428 available from Kawaguchi Denki K.K.) in a static process. Specifically, the photoreceptor was first measured for initial surface potential Vs when corona-charged at +6 kv and surface potential Vo developed after being stored in a dark place for 30 seconds. The photoreceptor was then exposed to light from a tungsten lamp in such a manner that the illuminance on the surface of the photoreceptor reached 3 lux. The photoreceptor was then measured for exposure $E_{50}$ required for surface potential to be halved and surface potential developed after exposed for 30 seconds (residual potential $V_R$). These measurements were repreated over 3,000 times. The results are set forth in Table 8.

TABLE 8

| | 1st time | 3,000th time |
|---|---|---|
| $E_{50}$ [lux · sec] | 1.5 | 1.7 |
| Vs [−V] | 890 | 840 |
| Vo [−V] | 710 | 670 |
| $V_R$ [−V] | 10 | 20 |

EXAMPLE 20

5 parts by weight of an acetylene disazo compound as used in Example 1, 40 parts by weight of p-(diphenylamino)benzaldehyde-N'-methyl-N'-phenylhydrazone and 100 parts by weight of a copolymer of benzyl methacrylate and methacrylic acid ([η] at 30° C. in methyl ethyl ketone=0.12; methacrylic acid content: 32.9%) were added to 660 parts by weight of dichloromethane. The mixture was then subjected to dispersion by means of a ball mill for 12 hours. The dispersion was coated on a 0.25-μm thick grained aluminum plate, and then dried to prepare an electrophotographic printing plate precursor comprising a 6-μm thick electrophotographic light-sensitive layer.

The specimen was then corona-charged at +6 kv so that the surface potential of the light-sensitive layer reached +500 V. The specimen was then exposed to light from a tungsten lamp with a color temperature of 2,854° K in such a manner that the illuminance on the surface thereof reached 2.0 lux. As a result, E50 was 2.6 lux.sec.

The specimen was then charged at a surface potential of +500 V in a dark place. The specimen was then imagewise exposed to light with a transparent original of positive image brought into close contact therewith. The specimen was then immersed in a liquid developer comprising 1 l of Isopar H (petroleum solvent produced by Esso Standard), 5 g of finely dispersed polymethyl methacrylate (toner) and 0.01 g of soybean oil lecithin. As a result, a sharp positive toner image could be obtained.

The specimen was then heated to a temperature of 100° C. for 30 seconds to fix the toner image. The printing plate material was immersed in an etching solution obtained by dissolving 70 g of sodium metasilicate hydrade in 140 ml of glycerin, 550 ml of ethylene glycol and 150 ml of ethanol for 1 minute. The printing plate material was washed in a water flow with light brushing to remove the light-sensitive layer on the portion free of the toner. Thus, the desired printing plate was obtained.

The printing plate thus prepared was then used for printing by means of Hamada Star 600 CD Offset Printer. As a result, 50,000 sheets of extremely sharp printed matters free of any stain on the background were obtained.

As has been described, the use of the acetylene disazo compound of the present invention can provide an electrophotographic photoreceptor which exhibits a high sensitivity and excellent repeatability and image uniformity and an electrophotographic printing plate precursor which exhibits excellent static properties and printability.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising on an electrically conductive support a light-sensitive layer containing at least one acetylene disazo compound represented by the general formula (i):

$$Cp—N{=}N—Ar^1—C{\equiv}C—Ar^2N{=}N—Cp \quad (I)$$

wherein $Ar^1$ and $Ar^2$ each represents an unsubstituted or substituted arylene group, divalent condensed polycyclic aromatic group or divalent aromatic heterocyclic group, with the proviso that $Ar^1$ and $Ar^2$ are not phenylene groups at the same time; and Cp represents a coupler residue.

2. The electrophotographic photoreceptor of claim 1, wherein the arylene group represented by $Ar^1$ or $Ar^2$ is selected from the group consisting of phenylene, naphthylene, anthrylene, biphenylene, and terphenylene.

3. The electrophotographic photoreceptor of claim 1, wherein the condensed polycyclic aromatic group represented by $Ar^1$ or $Ar^2$ is selected from the group consisting of indene, perylene, anthrone, anthraquinone, benzoanthrone, iso-coumarin, pyrene, acenapthene, fluorene, and azulene.

4. The electrophotographic photoreceptor of claim 1, wherein the aromatic heterocyclic group represented by $Ar^1$ or $Ar^2$ is selected from the group consisting of furan, thiophene, pyridine, quinoline, oxazole, thiazole, oxadiazole, benzoxazole, benzoimidazole, benzothiazole, benzotriazole, dibenzofuran, carbazole, and xanthene.

5. The electrophotographic photoreceptor of claim 1, wherein the substituent for $Ar^1$ or $Ar^2$ is selected from the group consisting of a $C_{1-18}$ alkyl group, a halogen atom, a cyano group, a nitro group, a hydroxyl group, a carboxyl group, a $C_{1-18}$ alkoxy group, a $C_{2-36}$ dialkylamino group, a $C_{12-36}$ diarylamino group, a $C_{7-36}$ N-alkyl-N-arylamoino group, a $C_{6-18}$ aryl group, a $C_{3-54}$ trialkylsilyl group, a $C_{1-18}$ halogen-alkyl group, and a $C_{1-18}$ alkylthio group.

6. The electrophotographic photoreceptor of claim 1, wherein Cp represents

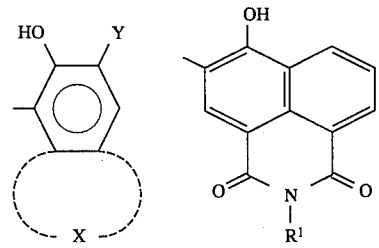

-continued

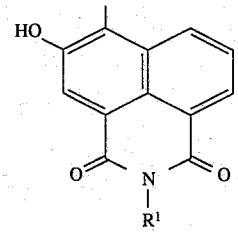

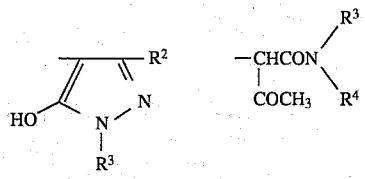

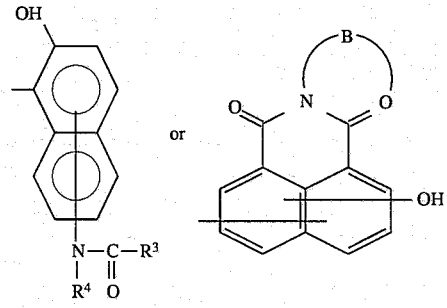

wherein X represents an atomic group which undergoes condensation with the benzene ring to which the hydroxyl group and Y are connected to form an aromatic group or a heterocyclic group;

Y represents —$CONR^3R^4$, —$CONHN{=}CR^3R^4$, —$COOR^3$ or 5- or 6-membered heterocyclic ring;

$R^1$ represents a $C_{1-12}$ alkyl or $C_{6-12}$ aryl group;

$R^2$ represents a hydrogen atom, a $C_{1-6}$ lower alkyl group, a carbamoyl group, a carboxyl group, an alkoxycarbonyl group containing a $C_{1-12}$ alkoxy group, an aryloxycarbonyl group containing a $C_{6-20}$ aryloxy group, or a substituted or unsubstituted amino group;

$R^3$ represents a $C_{1-20}$ alkyl group, a $C_{6-18}$ aromatic hydrocarbon group, or a heterocyclic group;

$R^4$ represents a hydrogen atom or has the same meaning as $R^3$; and

B represents a divalent aromatic hydrocarbon group or a divalent heterocyclic group.

7. The electrophotographic photoreceptor of claim 1, comprising on an electrically conductive support an electrophotographic light-sensitive layer having the disazo compound dispersed in a binder or a charge-transporting medium.

8. The electrophotographic photoreceptor of claim 1, comprising on an electrically conductive support a charge-generating layer containing the disazo compound as a main component and a charge-transporting layer provided thereon.

9. The electrophotographic photoreceptor of claim 1, comprising on an electrically conductive support a charge-transporting layer and a charge-generating layer containing the disazo compound as a main component provided thereon.

10. An electrophotographic printing plate precursor which comprises on an electrically conductive support a photoconducting layer containing at least a charge-generating substance, a charge-transporting substance and a binding resin and is adapted to be subjected to a process which comprises imagewise exposure of said precursor to form a toner image, and then removal of said photoconducting layer from the nonimage portion other than said toner image portion to form a printing plate, characterized in that said charge-generating substance is an acetylene disazo compound represented by the general formula (I):

$$Cp{-}N{=}N{-}Ar^1{-}C{\equiv}C{-}Ar^2N{=}N{-}Cp \qquad (I)$$

wherein $Ar^1$ and $Ar^2$ each represents an unsubstituted or substituted arylene group, divalent condensed polycyclic aromatic group or divalent aromatic heterocyclic group, with the proviso that $Ar^1$ and $Ar^2$ are not phenylene groups at the same time; and Cp represents a coupler residue.

11. The electrophotographic printing plate of claim 10, wherein the arylene group represented by $Ar^1$ or $Ar^2$ is selected from the group consisting of phenylene, naphthylene, anthrylene, biphenylene, and terphenylene.

12. The electrophotographic printing plate of claim 10, wherein the condensed polycyclic aromatic group represented by $Ar^1$ or $Ar^2$ is selected from the group consisting of indene, perylene, anthrone, anthraquinone, benzoanthrone, iso-coumarin, pyrene, acenapthene, fluorene, and azulene.

13. The electrophotographic printing plate of claim 10, wherein the aromatic heterocyclic group represented by $Ar^1$ or $Ar^2$ is selected from the group consisting of furan, thiophene, pyridine, quinoline, oxazole, thiazole, oxadiazole, benzoxazole, benzoimidazole, benzothiazole, benzotriazole, dibenzofuran, carbazole, and xanthene.

14. The electrophotographic printing plate of claim 10, wherein the substituent for $Ar^1$ or $Ar^2$ is selected from the group consisting of a $C_{1-18}$ alkyl group, a halogen atom, a cyano group, a nitro group, a hydroxyl group, a carboxyl group, a $C_{1-18}$ alkoxy group, a $C_{2-36}$ dialkylamino group, a $C_{12-36}$ diarylamino group, a $C_{7-36}$ N-alkyl-N-arylamoino group, a $C_{6-18}$ aryl group, a $C_{3-54}$ trialkylsilyl group, a $C_{1-18}$ halogen-alkyl group, and a $C_{1-18}$ alkylthio group.

15. The electrophotographic printing plate of claim 10, wherein Cp represents

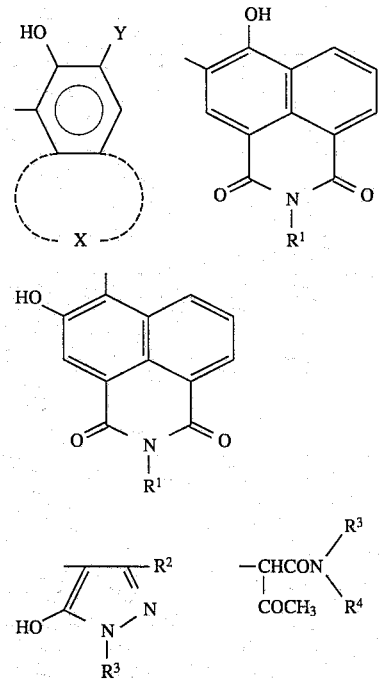

-continued

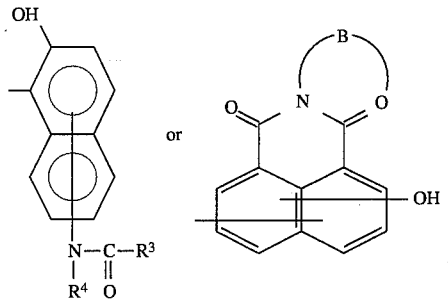

wherein X represents an atomic group which undergoes condensation with the benzene ring to which the hydroxyl group and Y are connected to form an aromatic group or a heterocyclic group;

Y represents —$CONR^3R^4$, —$CONHN{=}CR^3R^4$, —$COOR^3$ or 5- or 6-membered heterocyclic ring;

$R^1$ represents a $C_{1-12}$ alkyl or $C_{6-12}$ aryl group;

$R^2$ represents a hydrogen atom, a $C_{1-6}$ lower alkyl group, a carbamoyl group, a carboxyl group, an alkoxycarbonyl group containing a $C_{1-12}$ alkoxy group, an aryloxycarbonyl group containing a $C_{6-20}$ aryloxy group, or a substituted or unsubstituted amino group;

$R^3$ represents a $C_{1-20}$ alkyl group, a $C_{6-18}$ aromatic hydrocarbon group, or a heterocyclic group;

$R^4$ represents a hydrogen atom or has the same meaning as $R^3$; and

B represents a divalent aromatic hydrocarbon group or a divalent heterocyclic group.

* * * * *